United States Patent [19]

Kamei et al.

[11] Patent Number: 4,536,298

[45] Date of Patent: Aug. 20, 1985

[54] AQUEOUS FOAM FIRE EXTINGUISHER

[75] Inventors: Masayuki Kamei, Urawa; Tomio Endo, Takasaki; Yutaka Hashimoto, Urawa, all of Japan

[73] Assignees: Dainippon Ink and Chemicals, Inc., Tokyo; Kawamura Institute of Chemical Research, Saitama, both of Japan

[21] Appl. No.: 480,213

[22] Filed: Mar. 30, 1983

[51] Int. Cl.[3] ..... A62D 1/04; A62C 1/12

[52] U.S. Cl. ..... 252/8.05; 169/46; 169/47; 252/3

[58] Field of Search ..... 252/3, 6.5, 7, 8.05, 252/607, 2, 356, 357, 353, 351, 355, 307; 169/45, 46, 47

[56] References Cited

U.S. PATENT DOCUMENTS

| | | | |
|---|---|---|---|
| 3,957,657 | 5/1976 | Chiesa, Jr. | 252/3 |
| 3,957,658 | 5/1976 | Chiesa, Jr. et al. | 252/3 |
| 4,042,522 | 8/1977 | Falk | 252/8.05 |
| 4,049,556 | 9/1977 | Tujimoto et al. | 252/8.05 |
| 4,090,967 | 5/1978 | Falk | 252/3 |
| 4,278,552 | 7/1981 | Hisamoto et al. | 252/3 |
| 4,303,534 | 12/1981 | Hisamoto et al. | 252/3 |
| 4,350,206 | 9/1982 | Hoffmann et al. | 252/3 |
| 4,390,069 | 6/1983 | Rose, Jr. | 252/3 |
| 4,420,434 | 12/1983 | Falk | 252/3 |
| 4,424,133 | 1/1984 | Mulligan | 252/3 |
| 4,439,329 | 3/1984 | Kleiner et al. | 252/3 |

*Primary Examiner*—Stephen J. Lechert, Jr.
*Assistant Examiner*—Howard J. Locker
*Attorney, Agent, or Firm*—Sherman & Shalloway

[57] ABSTRACT

An aqueous foam fire extinguisher comprising (A) a surface-active agent having an anionic hydrophilic group, (B) a cationic water-soluble polymeric substance, and, optionally, (C) a polybasic acid compound.

12 Claims, No Drawings

AQUEOUS FOAM FIRE EXTINGUISHER

This invention relates to an aqueous foam fire extinguisher composition having an excellent fire extinguishing effect against fires of non-polar solvents, especially polar solvents.

Various fire extinguisher foams have been developed for use against fires of non-polar solvents such as gasoline, kerosene, light oils, heavy oils, crude oils, etc. However, when such fire extinguishers are applied to fires of polar solvents such as alcohols, ketones, esters, ethers and amines, the polar solvents take away water from the foam films, and the foams break instantaneously or become very weak. Hence, they can scarcely exhibit a fire extinguishing effect.

For this reason, protein foam fire extinguishers or synthetic surface active agent foam fire extinguishers containing water-insoluble metal soaps are now mainly used against the fires of polar solvents. The effect of these fire extinguishers is ascribed to the fact that when a concentrated solution of such a fire extinguisher is foamed by diluting it with water, the metal soap precipitates on the film surface of the foams and thus produces a barrier against the polar solvent, whereby the foams can be spread afloat on the liquid surface without being broken.

These fire extinguishers, however, have the serious defect unless they are used within 2 to 3 minutes after dilution with water at the site of fire, a precipitate forms in the water stream and markedly reduces their fire extinguishing effect, and that their foams disappear rapidly because they do not have sufficient solvent resistance. In order, therefore, to inject the foams onto the burning liquid surface, large quantities of foams must be placed very gently on the burning liquid surface, and special contrivances are required in the design of a foam discharge nozzle and in the method of installing it. Consequently, a large quantity of the fire extinguisher and a long period of time are required for fire extinguishing. For example, in extinguishing the fire of methanol, the spreading of the extinguisher foams becomes possible only after methanol has been diluted to about 75 to 80% with the fire extinguisher, and fire extinguishing takes a long time. Moreover, since such a large amount of the fire extinguisher is injected, the solvent is likely to overflow when fire takes place in a tank filled fully with the solvent.

There is also known a fluorinated foam fire extinguisher for use against the fire of polar solvents obtained by adding a certain kind of fluorine-type surface-active agent to a protein foam fire extinguisher thereby imparting resistance to polar solvents. This fluorinated protein foam fire extinguisher has not come into practical use because it also has the serious defect that it does not have a sufficient ability to extinguish fires of polar solvents, the foams do not have sufficient solvent resistance, a concentrated solution of the fire extinguisher lacks storage stability, and when it is diluted with sea water, the diluted solution is not stable.

In order to overcome these defects, it was proposed to add a thixotropic water-soluble polymeric substance (polysaccharide) to a water film-type foam fire extinguisher based on a fluorine-type surface-active agent. It is believed that when this type of fire extinguisher contacts a polar solvent, it is dehydrated on the interface to form a gel-like mat of the water-soluble polymeric substance in the interface, and the gel-like mat protects the foams existing thereon, whereby it covers the burning surface and finally extinguishes the fire. Thus, this fire extinguisher permits better spreading of foams than fire extinguishers of the metal soap type, and has an improved fire extinguishing effect. However, as will be anticipated from the mechanism by which the foams are protected by a gel-like mat of a thixotropic water-soluble polymeric substance, this fire extinguisher has a reduced fire extinguishing effect against fires of solvents having high volatility or generating high heat of combustion, such as alcohols (e.g., isopropanol, t-butanol, etc.), ketones, propylene oxide, etc.

Furthermore, since this type of fire extinguisher requires a large amount of the thixotropic water-soluble polymeric substance, its concentrated solution has a very high viscosity (more than 3,000 centistokes). Its viscosity, therefore, varies greatly with temperature, and it lends itself to difficult handling in practical applications. Furthermore, it cannot withstand storage for a long period of time because a thin layer (skin) of it is likely to form on the wall surface of the tank and the liquid surface during storage. This fire extinguisher cannot be used in a concentration lower than 6% because if the concentration of the thixotropic water-soluble polymeric substance is decreased, no gel-like mat is formed, or only a weak gel-like mat results. In addition, since this fire extinguisher has a freezing temperature of as high as about 0° C., does not reversibly freeze and melt. For this reason, special considerations are required in using or storing it in districts of cold climate.

The present inventors have made extensive investigations in order to solve the above problems, and discovered the unique mutual action of (A) a surface-active agent containing an anionic hydrophilic group and (B) a cationic water-soluble polymeric substance. This has led to the discovery that an aqueous foam fire extinguisher based on a mixture of these compounds (A) and (B) produces very stable foams not only on non-polar solvents but also on polar solvents.

Thus, according to this invention, there is provided an aqueous foam fire extinguisher comprising (A) a surface-active agent containing an anionic hydrophilic group and (B) a cationic water-soluble polymeric substance, which can form tough, stable foams having excellent flame resistance.

According to another aspect of this invention, there is provided an aqueous foam fire extinguisher of better performance comprising the aforesaid components (A) and (B) and as a third component, (C) a polybasic acid compound.

The surface-active agent having an anionic hydrophilic group used in this invention includes those which can electrostatically act on the cationic water-soluble polymeric substance. In this sense, it is essential that the surface-active agents should have at least one anionic hydrophilic group. Preferred anionic hydrophilic groups are, for example, —COOH, —$SO_3H$, —$OSO_3H$ and —$PO(OH)_2$. There may also be used those anionic hydrophilic groups which have an inorganic or organic cation as a counter ion for the anionic group.

The surface-active agent may be those which contain one or more anionic groups of the same or different kinds as the hydrophilic group, or amphoteric ion-type surface-active agents which contain one or both of a cationic hydrophilic group (such as an amino group or an ammonium group) and a nonionic group in addition to the anionic hydrophilic group.

The hydrophobic group of the surface-active agent may, for example, be an aliphatic hydrocarbon group having at least 6 carbon atoms, a dihydrocarbyl polysiloxane chain and/or a fluorinated aliphatic group having 3 to 20 carbon atoms. The surface-active agent may be a mixture of various kinds of compounds having these different hydrophobic groups.

Examples of especially useful surface active agents (A) having an anionic hydrophilic group are the following (A-1) to (A-4).

(A-1) Fluorine-containing amino acid-type amphoteric surface-active agents

General formula (A-1)

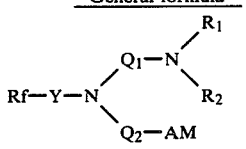

wherein Rf represents a fluorinated aliphatic group having 3 to 20 carbon atoms, Y represents $—SO_2—$ or —CO—, $Q_1$ and $Q_2$ represent an organic divalent linking group and is selected from aliphatic hydrocarbon groups, hydroxyl-substituted aliphatic hydrocarbon groups, aromatic hydrocarbon groups and substituted aromatic hydrocarbon groups, preferably $-(CH_2)_j-$ in which j is an integer of 1 to 6, or $$—CH_2\underset{\underset{OR_3}{|}}{C}HCH_2—$$

in which $R_2$ is a hydrogen atom or an alkyl group having 1 to 3 carbon atoms, $R_1$ and $R_2$ represent a hydrogen atom, an aliphatic hydrocarbon group having 1 to 12 carbon atoms, or an aliphatic hydrocarbon group substituted by a hydrophilic group, or $R_1$ and $R_2$ are linked to each other to form a ring together with the adjacent nitrogen atom, A represents an anionic hydrophilic group such as $—COO^-$, $—SO_3^-$, $—OSO_3^-$, or $—OPO(OH)O^-$, and M represents a hydrogen atom, an alkali metal, an alkali earth metal, an ammonium group or an organic cationic group.

Specific examples of these compounds are given below.

$C_8F_{17}SO_2N(CH_2)_3N(CH_3)_2$ — $CH_2COONa$ A-1-a $C_4F_9SO_2N(CH_2)_2N(C_2H_5)_2$ — $CH_2CH_2SO_3Na$ A-1-b $C_6F_{13}SO_2N(CH_2)_3N(C_3H_7)_2$ — $CH_2CH_2CH_2SO_3Na$ A-1-c $C_8F_{17}SO_2N(CH_2)_3N(CH_3)_2$ — $CH_2CH(OH)CH_2SO_3Na$ A-1-d $C_6F_{13}SO_2N(CH_2)_3N(CH_3)_2$ — $CH_2CH_2COONa$ A-1-e $C_6F_{13}SO_2NCH_2CH_2OCH_2CH_2CH_2N(CH_3)_2$ — $CH_2CH_2SO_3Na$ A-1-f

-continued $C_6F_{13}SO_2N(CH_2)_3N(CH_3)_2$ — $CH_2CH_2CH_2SO_3Na$ A-1-g $C_6F_{13}SO_2NCH_2CH(OH)CH_2N(CH_3)_2$ — $CH_2CH(OH)CH_2SO_3Na$ A-1-h $C_7F_{15}CON(CH_2)_2N(CH_3)_2$ — $(CH_2)_3SO_3Na$ A-1-i $C_5F_{11}CON(CH_2)_3NH_2$ — $CH_2COONa$ A-1-j $C_8F_{17}SO_2N(CH_2)_3N(CH_3)_2$ — $CH_2CH_2OSO_3Na$ A-1-k $C_8F_{17}SO_2N(CH_2)_3N(C_2H_4OH)_2$ — $(CH_2)_3SO_3Na$ A-1-l $C_7F_{15}CON(CH_2)_3NHCH_3$ — $CH_2$—$C_6H_4$—$SO_3Na$ A-1-m $C_7F_{15}CON(CH_2)_3NH_2$ — $CH_2CH(OH)CH_2SO_3Na$ A-1-n $C_6F_{13}SO_2N(CH_2)_3N(CH_3)_2$ — $CH_2CH_2OSO_3Na$ A-1-o $C_6F_{13}SO_2NCH_2CH(OH)CH_2N(CH_2CH_2OH)_2$ — $(CH_2)_3SO_3Na$ A-1-p $C_8F_{17}SO_2N(CH_2)_3N(CH_3)_2$ — $CH_2CH_2OPOONa$ A-1-q $C_3F_7OCF(CF_3)CF_2OCF(CF_3)CF_2CON(CH_2)_3—N(CH_3)_2$ — $CH_2COONa$ A-1-r $CF_3CF_2CF_2[OCF(CF_3)CF_2]_4OCF(CF_3)—CF_2CON(CH_2)_3N(CH_3)_2$ — $(CH_2)_3SO_3Na$ A-1-s $C_9F_{17}O$—$C_6H_4$—$SO_2N$(—$(CH_2)_3N(CH_3)_2$)(—$(CH_2)_3SO_3Na$) A-1-t $C_8F_{17}CH_2CH_2SO_2N$(—$(CH_2)_3N(CH_3)_2$)(—$CH_2$—$C_6H_4$—$SO_3Na$) A-1-u $C_6F_{11}O$—$C_6H_4$—$CON$(—$(CH_2)_3N(CH_3)_2$)(—$(CH_2)_3SO_3Na$) A-1-v Fluorine-containing aminosulfonate type surface-active agents (A-2)

wherein Rf represents a fluorinated aliphatic group having 3 to 20 carbon atoms, Z is a divalent linking group and represents $-SO_2N(R_1)-$, $CON(R_1)$, $-(CH_2CH_2)_i-SO_2N(R_1)-$,

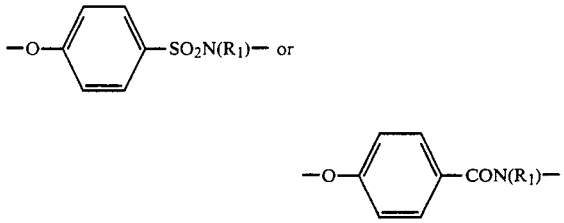

(in which $R_1$ represents a hydrogen atom or an alkyl group having 1 to 12 carbon atoms, and i represents an integer of 1 to 10), $Q_1$ represents $-(CH_2)_j-$ (in which j is an integer of 1 to 6) or $$-CH_2\underset{\underset{OR_2}{|}}{C}HCH_2-$$

($R_2$ represents a hydrogen atom or an alkyl group having 1 to 3 carbon atoms), R represents a hydrogen atom, an alkyl or hydroxyalkyl group having 1 to 3 carbon atoms, $-Q_2SO_3M$ or $-(CH_2)_kCOOM$ (in which k represents an integer of 1 to 4), $Q_2$ represents $-(CH_2)_l-$ (in which l represents an integer of 1 to 4), $$-CH_2\underset{\underset{OR_3}{|}}{C}HCH_2-$$

(in which $R_3$ represents a hydrogen atom or an alkyl group having 1 to 3 carbon atoms), or

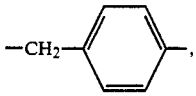

M represents a cationic atom or atomic grouping, and represents a hydrogen atom, an alkali metal, an alkaline earth metal or $-N(H)_m(R_4)_n$ (in which $R_4$ represents an alkyl or hydroxyalkyl group having 1 to 3 carbon atoms, and m and n are integers of 0 to 4 provided that $m+n=4$).

Specific examples of these compounds are given below.

A-2-a: $C_8F_{17}SO_2NH(CH_2)_3N(CH_3)(CH_2)_3SO_3Na$

A-2-b: $C_8F_{17}SO_2NH(CH_2)_3N(CH_2CH_2OH)(CH_2)_3SO_3Na$

A-2-c: $C_6F_{13}SO_2N(CH_3)(CH_2)_3N(C_2H_5)CH_2CH(OH)-CH_2SO_3K$

A-2-d: $C_7F_{15}CONH(CH_2)_2N(CH_3)(CH_2)_3SO_3Na$

A-2-e

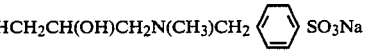

A-2-f: $C_8F_{17}CH_2CH_2SO_2NH(CH_2)_3N(CH_3)(CH_2)_3SO_3Na$

A-2-g:

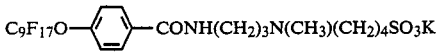

A-2-h:

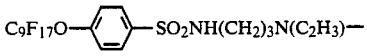

-continued

A-2-i:

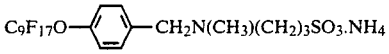

A-2-j: $C_9F_{18}(OCH_2CH_2)_2N(CH_3)(CH_2)_3SO_3\cdot N(C_2H_5)_4$

A-2-k: $C_7F_{15}CH_2CH_2SCH_2COO(CH_2)_2N(CH_3)-(CH_2)_2SO_3Na$

A-2-l: $C_3F_7OCF(CF_3)CF_2OCF(CF_3)CF_2CONH-(CH_2)_3N(CH_3)(CH_2)_3SO_3Na$

A-2-m: $CF_3CF_2CF_2[OCF(CF_3)CF_2]_4OCF(CF_3)CF_2CONH-(CH_2)_3N(CH_3)(CH_2)_2SO_3K$

A-2-n:

$$C_8F_{17}SO_2NH(CH_2)_3N\begin{matrix}(CH_2)_3SO_3Na\\(CH_2)_3SO_3Na\end{matrix}$$

A-2-o:

$$C_6F_{13}CH_2CH_2\overset{H}{N}(CH_2)_3\overset{CH_3}{N}(CH_2)_3SO_3Na$$

A-2-p:

$$C_7F_{15}CONH(CH_2)_3N\begin{matrix}CH_2COONa\\(CH_2)_3SO_3Na\end{matrix}$$

(A-3) Fluorine-containing aminocarboxylate-type surface-active agents

General formula $$Rf-Z-Q-N\begin{matrix}Q_1-COOM_1\\Q_2-COOM_2\end{matrix} \qquad (A\text{-}3)$$

wherein Rf represents a polyfluoroalkyl group having 3 to 20 carbon atoms which may contain an oxygen atom, a polyfluoroalkenyl group, a polyfluorocyclohexyl group, a polyfluorocyclohexyl-alkyl group or a polyfluorocyclohexyl-alkenyl group, Z represents a divalent linking group selected from $$-SO_2\underset{\underset{R_1}{|}}{N}-,\ -CON(R_1)-,\ -(CH_2CH_2)_r-SO_2\underset{\underset{R_1}{|}}{N}-,$$

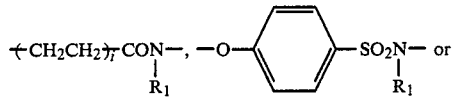

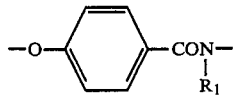

[in which $R_1$ represents an alkyl group having 1 to 12 carbon atoms, an alkenyl group, or a monovalent group containing an aromatic ring, or $-CH_2CH_2-_jR_2$ (in which $R_2$ represents a hydrogen atom or an alkyl group having 1 to 6 carbon atoms, and j represents an integer of 1 to 6), and i represents an integer of 1 to 3], Q represents $-(CH_2)_l-$, $$-CH_2\underset{\underset{OH}{|}}{C}HCH_2-,$$

$-(CH_2)_m-O-(CH_2)_m-$ or $-(CH_2)_p-O-(CH_2)_2-O-(CH_2)_q-$ (in which l is an integer of 1 to 6, m and n are integers of 2 to 6, and p and q are 2 or 3), and each of $Q_1$ and $Q_2$ represents a divalent linking group $-(CH-$ $_2\rangle_r$ or $-(CH_2)_s$ (in which r and s are integers of 1 to 3), and each of $M_1$ and $M_2$ represents a hydrogen atom or an inorganic or organic cation.

Specific examples of the compounds (A-3) are given below.

A-3-a:

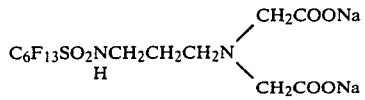

A-3-b:

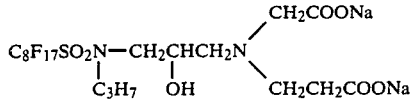

A-3-c:

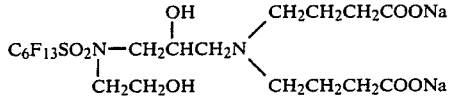

A-3-d:

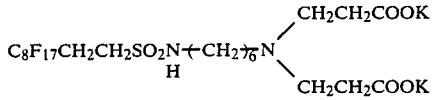

A-3-e:

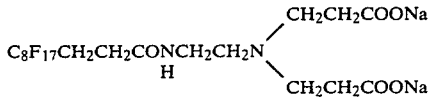

A-3-f:

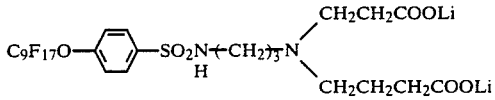

A-3-g:

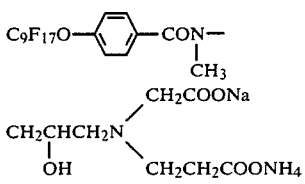

A-3-h:

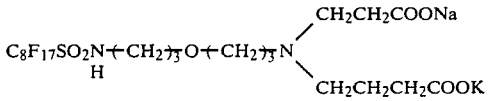

A-3-i:

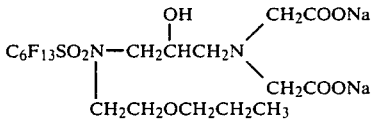

A-3-j:

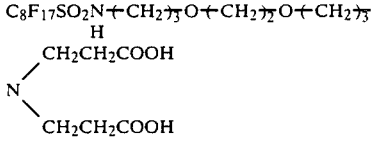

A-3-k:

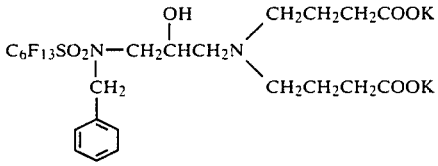

Specific examples of these compounds are given below.

A-4-a:

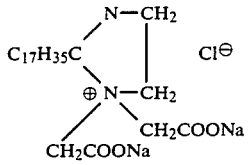

A-4-b: $C_{11}H_{23}CONHCH_2CH_2N(CH_2COONa)_2$

A-4-c: $C_{17}H_{35}CONH(CH_2)_3\overset{\oplus}{N}[(CH_2)_3SO_3Na]_3\ Cl^{\ominus}$ A-4-d: $Si(CH_3)_3O\left[Si(CH_3)O\right]_n Si(CH_3)_3$
$(CH_2)_3OCH_2CH(OH)CH_2\overset{\oplus}{N}(CH_3)-[(CH_2)_2SO_3Na]_2Cl^{\ominus}$ A-4-e: $C_8F_{17}SO_2N(C_3H_7)CH_2COOK$
A-4-f: $C_8F_{17}SO_2N(C_3H_7)CH_2CH_2OSO_3Na$
A-4-g: $C_7F_{15}CON(C_3H_7)(CH_2)_3SO_3Na$ The cationic water-soluble polymeric substance (B) used in this invention is a polyamine-type polymeric substance which contains a primary amino group, a secondary amino group, a tertiary amino group, an ammonium group, a pyridinium group or a quaternary ammonium group at the main chain or side chain and has a solubility in water of at least 0.1% by weight. The degree of polymerization of this polymeric substance is restricted by its solubility in water, but polymeric substances having a degree of polymerization in the oligomer region to a degree of polymerization of more than several hundred thousand may be used. Preferred polymeric substances have a molecular weight of about 600 to about 100,000.

Specific examples of especially useful polymeric substances as the cationic water-soluble polymeric substance (B) in this invention are the following B-I to B-X.

Polyethylenimine B-I.

Polymer of

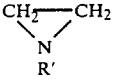

(Polyethylenimine derivatives) B-II.

wherein R' is $-C_nH_{2n+1}$, $-COC_nH_{2n+1}$ or $-(CH_2CH_2O)_nH$ in which n is an integer of 1 to 6 such as (a) poly(N—methylethylenimine), (b) poly(N—acetylethylenimine) and (c) poly (N—hydroxyethylenimine).

Polymer of $CH_2{=}CH$ B-III.

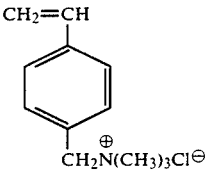

Polymer of $CH_2{=}CH$ B-IV.

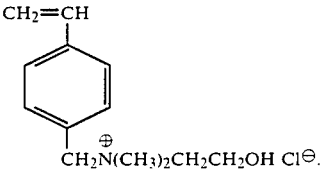

-continued

B-V.

Polymer of $CH_2{=}CH$

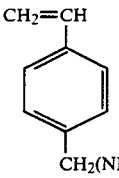

$CH_2(NHCH_2CH_2)_mNH_2$.

(m is an integer of 1 to 10)

B-VI.

Polymer of $CH_2{=}CH$

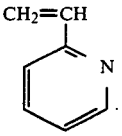

B-VII.

Polymer of $CH_2{=}CH$ $N(CH_3)_2$.

B-VIII.

Polymer of $CH_2{=}CH$ $N(C_2H_5)_2$.

B-IX. Polyamide polyamine epichlorohydrin

B-X. Guanidine-formaldehyde polycondensate

The unique synergistic effect of the surface-active agent containing an anionic hydrophilic group and the cationic water-soluble polymeric substance on the foam characteristics of the fire extinguisher is observed over a broad range of the bending ratios of the two. The preferred range of the blending ratio of the cationic water-soluble polymeric substance (B) to the surface-active agent (A), i.e. (B)/(A), varies depending upon the combination of the two components, and is difficult to determine unequivocally. Generally, the weight ratio of (B)/(A) is from 0.05 to 50, preferably from 0.1 to 10. If the proportion of the cationic water-soluble polymeric substance (B) is too low, a complex formed between it and the surface-active agent (A) becomes water-insoluble and its foamability is greatly reduced. If the above blending ratio exceeds 50, the synergistic effect of the two is not impaired, but the viscosity of the concentrated or diluted solution of the fire extinguisher increases remarkably to reduce the commercial value of the fire extinguisher.

The unique synergistic effect in accordance with this invention appears most at a pH of 6 to 8. Desirably, fire extinguishers are generally used in a pH range from weak acidity to seek alkalinity in order to secure safety to man and other living organisms and to inhibit the corrosion of storage containers. From this viewpoint, too, the fire extinguisher of this invention has utility.

The fire extinguisher of this invention, whether in a concentrated or diluted form, has excellent dissolution stability and outstanding long-term storage stability. A concentrated solution of the fire extinguisher which can be diluted to a high ratio can be easily produced because of the excellent solubility and the low viscosity of the individual components. The viscosity of a 3% type concentrated solution of the fire extinguisher of this invention can be adjusted to not more than 100 centistokes at 20° C., and this solution has excellent handlability in practical applications. Another characteristic of this invention is that since the amount of the cationic water-soluble polymeric substance (B) can be small, it is easy to reduce the freezing point of the concentrated solution of the fire extinguisher to −10° to −20° C.

The polybasic acid compound (C) which can be used in combination with the surface-active agent (A) and the cationic water-soluble polymeric substance (B) in this invention is a non-surface active compound and includes, for example, aromatic, aliphatic, alicyclic, and heterocyclic dibasic, tribasic, tetrabasic, pentabasic and hexabasic acids, and their alkali metal and ammonium salts. A broad range of polybasic acid compounds ranging from low-molecular-weight compounds to polymeric compounds having a carboxyl group in the side chain may be used. Since, however, the polymeric compounds may frequently produce a water-insoluble gel-like precipitate as a result of increasing the viscosity of the fire extinguisher or its reaction with the cationic water-soluble polymeric compound, it is preferred to use polybasic acid compounds having a relatively low molecular weight, particularly dibasic acid compounds having 3 to 24 carbon atoms, preferably 4 to 18 carbon atoms. The acid groups of the polybasic acid compounds include carboxylic, sulfonic, and phosphoric acid groups. Specific examples of the polybasic acid compound (C) are given below.

$HOOC{+}CH_2{\rangle}_nCOOH$ (C-1)

(n = integer of 2 to 12)

$HOOC{+}CH(OH){\rangle}_2COOH$ (C-2)

$H_2N(CH_2CH_2COOH)CHCOOH$ (C-3)

(C-4)

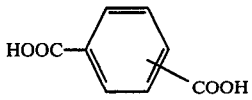

$HOOC{-}C(H){=}C(H){-}COOH$ (C-5)

(C-6)

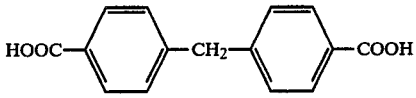

$HO_3S{-}CH_2CH_2{-}N(CH_3){-}CH_2SO_3H$ (C-7)

(C-8)

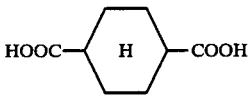

(C-9)

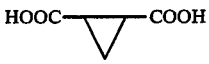

(C-10)

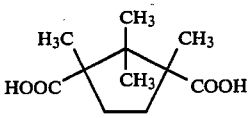

(C-11)

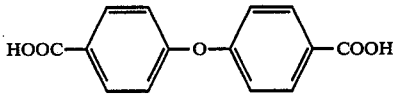

-continued (C-12)

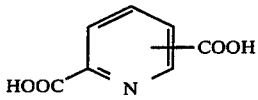

(C-13)

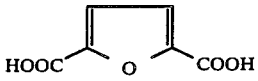

(C-14) $HOOC-CH_2-O-CH_2-COOH$ (C-15) $HOOC-CH_2-O-CH_2CH_2-O-CH_2-COOH$ (C-16)

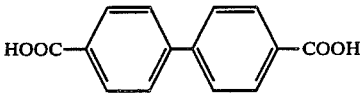

(C-17)

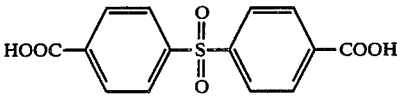

(C-18)

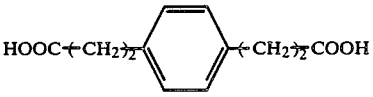

(C-19)

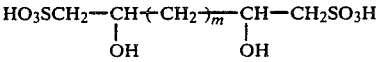

(m = integer of 2 to 6)

(C-20)

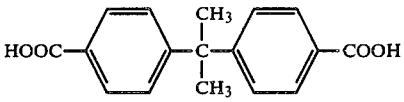

(C-21)

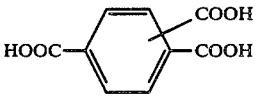

(C-22)

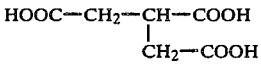

(C-23)

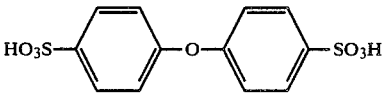

(C-24)

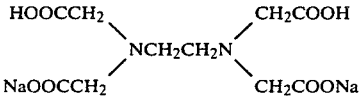

(C-25)

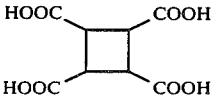

(C-26)

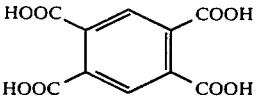

(C-27)

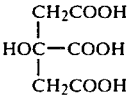

-continued (C-28)

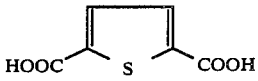

(C-29) $HO_3S\text{-}(CH_2)_l\text{-}SO_3H$ (l = integer of 2 to 6)

(C-30) $HO_3SO\text{-}(CH_2)_p\text{-}OSO_3H$ (p = integer of 2 to 6)

(C-31) $HO_3PO\text{-}(CH_2)_q\text{-}OPO_3H$ (q = integer of 2 to 6)

(C-32)

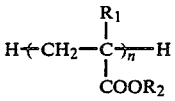

($R_1$ represents hydrogen or a methyl group, $R_2$ represents hydrogen or an alkali metal such as Li, Na, or K, or an ammonium group, and n is an integer of 5 to 100)

The mixing ratio of the cationic water-soluble polymeric substance (B) to the polybasic acid compound (C) is from 5:1 to 1:3, preferably from 4:1 to 1:1, by weight.

The fire extinguisher of this invention consists essentially of the surface-active agent (A) containing an anionic hydrophilic group and the cationic water-soluble polymeric substance (B), and its fire extinguishing performance is markedly increased by additionally including the polybasic acid compound (C). The mixing proportion of the polybasic acid (C) is such that the weight ratio of the component (A) to the components (B)+(C), i.e. A/B+C, is from 0.01 to 10, preferably from 0.1 to 2.

The advantages of the fire extinguisher of this invention are as follows:

(1) The fire extinguishing time can be shortened.

(2) It has increased liquid resistance. In other words, the life of its foams in contact with a polar solvent such as methanol and acetone is prolonged.

(3) Its foams have increased stability. Specifically, at the same foaming ratio, the 25% drainage time, 50% drainage time and 75% drainage time, as measures of foam stability, are prolonged.

(4) It has increased economy. Since the amount of a fluorine-containing surface-active agent which is more than 100 times as costly as ordinary surface-active agents (for example, detergents) can be decreased, the fire extinguisher can be supplied at a lower cost.

In addition to the surface-active agent (A), the water-soluble polymeric substance (B) and the polybasic acid compound (C) as an optional component, various additives may be included in the fire extinguisher of this invention. Examples of the additives include foam stabilizers, freezing point depressants, rust inhibitors and pH adjusting agents. The foam stabilizers are added to adjust the foam expansion ratio of the fire extinguisher, and may, for example, be nonionic surface active agents, cationic surface active agents, polyethylene glycol and polyvinyl alcohol. Examples of the freezing point depressants are ethylene glycol, propylene glycol, ethers of the Cellosolve type, carbitols, lower alcohols, and urea. The rust inhibitors and pH adjusting agents may be various compounds known in the art.

The fire extinguisher of this invention is applied to the site of fire by a known method, specifically by blowing or mixing air, carbon dioxide gas, nitrogen, a lowboiling fluorocarbon such as difluorodichloromethane, or another suitable incombustible gas into or with it. For example, when the fire extinguisher of this invention is stored as a concentrated solution, it is diluted to a suitable ratio by usual methods (for example, by causing it to be drawn into a water stream being sent toward a fire extinguishing device or a foam nozzle), and mixed with an incombustible gas such as air to foam it, and the resulting foams are jetted or sent to a burning surface from above or into below the burning surface.

If desired, the fire extinguisher of this invention may be used in combination with powdery fire extinguishers, protein foam extinguishers, foam fire extinguishers for use against fires of wooden materials, etc.

The following examples illustrate the present invention in greater detail. All percentages in these examples are by weight.

EXAMPLE 1

| | |
|---|---|
| $C_8F_{17}SO_2NH(CH_2)_3N(CH_3)(CH_2)_3SO_3Na$ | 5% |
| Polyethylenimine (molecular weight: 40,000 to 70,000) | 6% |
| Ethylene glycol | 15% |
| Butyl carbitol | 15% |
| Water | 59% |

A mixture of the above ingredients was stirred at room temperature to form a clear solution. A very small amount of 1:1 HCl (water:HCl=1:1) was added to the solution to adjust its pH to 7.5. The properties of the resultant fire extinguisher (3% type concentrated solution) are shown in Table 1.

EXAMPLE 2

| | |
|---|---|
| $C_8F_{17}SO_2N(CH_2)_2NHCONHC_2H_5)(CH_2CH(OH)CH_2SO_3Na)$ | 5% |
| Polyethylenimine (molecular weight 40,000 to 70,000) | 6% |
| Ethylene glycol | 15% |
| Butyl carbitol | 15% |
| Water | 59% |

A mixture of these ingredients was stirred at room temperature to form a clear solution. A very small amount of 1:1 HCl was added to the solution to adjust its pH to 7.5. The properties of the resulting fire extinguisher (3% type concentrated solution) are shown in Table 1.

EXAMPLE 3

| | |
|---|---|
| $C_8F_{17}SO_2NH(CH_2)_3N(CH_2COONa)_2$ | 5% |
| Polyethylenimine (molecular weight 40,000 to 70,000) | 6% |
| Ethylene glycol | 15% |
| Butyl carbitol | 15% |
| Water | 51% |

A mixture of these ingredients was stirred at room temperature to form a clear solution. A very small amount of 1:1 HCl was added to adjust its pH to 7.5. The properties of the resulting fire extinguisher (3% type concentrated solution) are shown in Table 1.

TABLE 1

| Example | Appearance | Freezing point at −C.) | Viscosity at −10° C. (cst) | Test for the amount of a precipitate (*1) |
|---|---|---|---|---|
| 1 | Completely clear | −18 | 165 | Trace |
| 2 | Completely clear | −18 | 170 | Trace |
| 3 | Completely Clear | −17 | 180 | Trace |

(*1): Conducted in accordance with the method described in Ordinance No. 26 of Ministry of Home Affairs, Japan on the concentrated solutions which had been subjected to a degeneration test.

EXAMPLES 4 to 100

| | |
|---|---|
| Surface-active agent (A-1 to A-4) | 5% |
| Cationic water-soluble polymer (B-I to B-VIII) | 6% |
| Ethylene glycol | 15% |
| Butyl carbitol | 15% |
| Water | 59% |

The surface-active agent and the cationic water-soluble polymer were mixed in the above proportions with stirring. A very small amount of 1:1 HCl was added to adjust the pH of the solution to 7.5.

The properties of the resulting fire extinguishers (3% type concentrated solutions) obtained in the above manner are shown in Table 2. The polymers used had the following molecular weights.

| Polymer | Molecular weight |
|---|---|
| B-I | 40,000–70,000 |
| B-II-(a)~(c) | 30,000–70,000 (partially acylated product; $N:CH_3\overset{O}{\overset{\|}{C}}$ = 10:1) |
| B-III | 9,000–10,000 |
| B-IV | 10,000–12,000 |
| B-V | 11,000–17,000 |
| B-VI | 5,000–8,000 |
| B-VII | 7,000–9,000 |
| B-VIII | 7,500–9,500 |

TABLE 2

| Example | Surface-active agent (A) | Cationic water-soluble polymer (B) | Appearance | Freezing point (°C.) | Viscosity at −10° C. (cst) | Test for the amount of a precipitate (*1) |
|---|---|---|---|---|---|---|
| 4 | A-1-a | I | Completely clear | −17 | 170 | Trace |
| 5 | A-1-c | I | Completely clear | −17 | 170 | " |
| 6 | A-1-d | I | Completely clear | −16 | 165 | " |

TABLE 2-continued

| Example | Surface-active agent (A) | Cationic water-soluble polymer (B) | Appearance | Freezing point (°C.) | Viscosity at −10° C. (cst) | Test for the amount of a precipitate (*1) |
|---|---|---|---|---|---|---|
| 7 | A-1-m | I | Completely clear | −17 | 170 | " |
| 8 | A-1-p | I | Completely clear | −18 | 165 | " |
| 9 | A-1-r | I | Completely clear | −14 | 164 | " |
| 10 | A-1-t | I | Completely clear | −17 | 167 | " |
| 11 | A-1-u | I | Completely clear | −16 | 165 | " |
| 12 | A-1-v | I | Completely clear | −16 | 171 | " |
| 13 | A-1-b | II-a(a) | Completely clear | −15 | 170 | " |
| 14 | A-1-e | II-(b) | Completely clear | −16 | 174 | " |
| 15 | A-1-f | II-(c) | Completely clear | −17 | 166 | " |
| 16 | A-1-g | II-(a) | Completely clear | −18 | 168 | " |
| 17 | A-1-h | II-(a) | Completely clear | −13 | 172 | " |
| 18 | A-1-j | II-(b) | Completely clear | −16 | 170 | " |
| 19 | A-1-k | II-(b) | Completely clear | −17 | 165 | " |
| 20 | A-1-n | II-(c) | Completely clear | −14 | 167 | " |
| 21 | A-1-o | I | Completely clear | −14 | 164 | " |
| 22 | A-1-s | I | Completely clear | −14 | 170 | " |
| 23 | A-1-c | II-(a) | Completely clear | −15 | 164 | " |
| 24 | A-1-c | III | Completely clear | −14 | 167 | " |
| 25 | A-1-c | IV | Completely clear | −16 | 169 | " |
| 26 | A-1-c | V | Completely clear | −16 | 170 | " |
| 27 | A-1-c | VI | Completely clear | −16 | 164 | " |
| 28 | A-1-c | VII | Completely clear | −18 | 164 | " |
| 29 | A-1-c | VIII | Completely clear | −17 | 167 | " |
| 30 | A-1-d | III | Completely clear | −16 | 169 | " |
| 31 | A-1-m | IV | Completely clear | −16 | 170 | " |
| 32 | A-1-r | V | Completely clear | −17 | 167 | " |
| 33 | A-1-t | VII | Completely clear | −16 | 173 | " |
| 34 | A-1-u | VI | Completely clear | −17 | 174 | " |
| 35 | A-1-v | VIII | Completely clear | −15 | 170 | " |
| 36 | A-2-a | I | Completely clear | −14 | 169 | " |
| 37 | A-2-c | I | Completely clear | −17 | 169 | " |
| 38 | A-2-d | I | Completely clear | −19 | 166 | " |
| 39 | A-2-f | I | Completely clear | −15 | 167 | " |
| 40 | A-2-h | I | Completely clear | −18 | 163 | " |
| 41 | A-2-i | I | Completely clear | −17 | 170 | " |
| 42 | A-2-j | I | Completely clear | −15 | 180 | " |
| 43 | A-2-k | I | Completely clear | −16 | 170 | " |
| 44 | A-2-l | I | Completely clear | −16 | 172 | " |
| 45 | A-2-n | I | Completely | −14 | 169 | " |

TABLE 2-continued

| Example | Surface-active agent (A) | Cationic water-soluble polymer (B) | Appearance | Freezing point (°C.) | Viscosity at −10° C. (cst) | Test for the amount of a precipitate (*1) |
|---|---|---|---|---|---|---|
| | | | clear | | | |
| 46 | A-2-o | I | Completely clear | −15 | 167 | " |
| 47 | A-2-a | II-(a) | Completely clear | −16 | 167 | " |
| 48 | A-2-f | II-(b) | Completely clear | −15 | 160 | " |
| 49 | A-2-g | II-(a) | Completely clear | −15 | 168 | " |
| 50 | A-2-m | II-(b) | Completely clear | −16 | 169 | " |
| 51 | A-2-o | II-(a) | Completely clear | −17 | 165 | " |
| 52 | A-2-c | II-(a) | Completely clear | −16 | 180 | " |
| 53 | A-2-c | III | Completely clear | −17 | 172 | " |
| 54 | A-2-c | IV | Completely clear | −17 | 170 | " |
| 55 | A-2-d | II-(a) | Completely clear | −17 | 173 | " |
| 56 | A-2-c | V | Completely clear | −17 | 174 | " |
| 57 | A-2-c | VI | Completely clear | −16 | 165 | " |
| 58 | A-2-c | VIII | Completely clear | −17 | 167 | " |
| 59 | A-2-c | VIII | Completely clear | −15 | 168 | " |
| 60 | A-2-e | VI | Completely clear | −16 | 170 | " |
| 61 | A-2-i | VII | Completely clear | −14 | 163 | " |
| 62 | A-2-k | V | Completely clear | −14 | 164 | " |
| 63 | A-2-n | IV | Completely clear | −17 | 165 | " |
| 64 | A-3-a | I | Completely clear | −14 | 170 | " |
| 65 | A-3-b | I | Completely clear | −15 | 173 | " |
| 66 | A-3-d | I | Completely clear | −15 | 174 | " |
| 67 | A-3-f | I | Completely clear | −14 | 173 | " |
| 68 | A-3-h | I | Completely clear | −16 | 181 | " |
| 69 | A-3-i | I | Completely clear | −16 | 163 | " |
| 70 | A-3-k | I | Completely clear | −11 | 173 | " |
| 71 | a-3-c | II-(b) | Completely clear | −14 | 174 | " |
| 72 | A-3-d | II-(b) | Completely clear | −15 | 171 | " |
| 73 | A-3-e | II-(a) | Completely clear | −14 | 166 | " |
| 74 | A-3-g | II-(c) | Completely clear | −13 | 165 | " |
| 75 | A-3-j | II-(c) | Completely clear | −14 | 171 | " |
| 76 | A-3-b | III | Completely clear | −16 | 175 | " |
| 77 | A-3-b | IV | Completely clear | −13 | 164 | " |
| 78 | A-3-b | V | Completely clear | −15 | 163 | " |
| 79 | A-3-b | VI | Completely clear | −14 | 167 | " |
| 80 | A-3-b | VII | Completely clear | −13 | 170 | " |
| 81 | A-3-b | VIII | Completrly clear | −17 | 180 | " |
| 82 | A-3-c | V | Completely clear | −16 | 164 | " |
| 83 | A-3-f | IV | Completely clear | −14 | 160 | " |

TABLE 2-continued

| Example | Surface-active agent (A) | Cationic water-soluble polymer (B) | Appearance | Freezing point (°C.) | Viscosity at −10° C. (cst) | Test for the amount of a precipitate (*1) |
|---|---|---|---|---|---|---|
| 84 | A-3-h | VI | Completely clear | −15 | 154 | " |
| 85 | A-3-j | VII | Completely clear | −16 | 170 | " |
| 86 | A-4-a | I | Completely clear | −16 | 146 | " |
| 87 | A-4-b | I | Completely clear | −16 | 140 | " |
| 88 | A-4-c | I | Completely clear | −17 | 150 | " |
| 89 | A-4-d | I | Completely clear | −16 | 148 | " |
| 90 | A-4-e | I | Completely clear | −17 | 149 | " |
| 91 | A-4-f | II-(a) | Completely clear | −15 | 150 | " |
| 92 | A-4-g | II-(b) | Completely clear | −15 | 143 | " |
| 93 | A-4-b | II-(a) | Completely clear | −16 | 144 | " |
| 94 | A-4-c | III | Completely clear | −16 | 146 | " |
| 95 | A-4-d | II-(c) | Completely clear | −17 | 153 | " |
| 96 | A-4-f | III | Completely clear | −15 | 154 | " |
| 97 | A-4-g | IV | Completely clear | −16 | 170 | " |
| 98 | A-4-c | III | Completely clear | −16 | 153 | " |
| 99 | A-4-c | IV | Completely clear | −15 | 155 | " |
| 100 | A-4-c | VII | Completely clear | −15 | 159 | " |

(*1): Same as the footnote to Table 1.

The fire extinguishers of this invention obtained in Examples 1 to 100 were subjected to a fire extinguishing test in accordance with the method described in Ordinance No. 26 of the Ministry of Home Affairs. For comparison, a fire extinguisher containing a thixotropic water-soluble polymeric material (a commercial product containing a fluorine-type surface-active agent) was also tested. The outline of the experimental procedure was as follows:

The scale of fire was such that a B-20 model having a combustion area of 4 $m^2$ was used and 400 liters of a fuel (solvent) was charged. But in the case of propylene oxide as a fuel, the fire size was 2 $m^2$ (B-10 model) and 200 liters of the fuel was charged. The pre-burning time was 5 minutes. Each of the concentrated solutions of fire extinguishers was diluted with fire extinguishing water and filled in a pressure container. It was foamed under a nitrogen pressure of 7.0 $kg/cm^2$ by passing it through a standard foaming nozzle for testing water-film type extinguisher foams, and the foams were supplied to the burning liquid surface. The rate of discharge was adjusted to 10 liters/min and the total discharge time was adjusted to 5 minutes. The results are shown in Table 3.

TABLE 3

| Example | Dilution water | Dilution ratio (%) | Burning solvent | Foam expansion ratio | Extinguishing time (min./sec.) | Vapor sealing property (*1) | Heat resistance (*2) (cm ϕ) |
|---|---|---|---|---|---|---|---|
| 1 | Sea water | 3 | iso-Propanol | 5.7 | 4/12 | Did not ignite | 25 |
| | Fresh water | " | " | 6.1 | 2/50 | " | 17 |
| 2 | Sea water | " | iso-Propanol | 5.9 | 3/50 | " | 23 |
| | Fresh water | " | " | 6.3 | 3/13 | " | 15 |
| 3 | Sea water | " | iso-Propanol | 5.6 | 3/10 | " | Self-extinguishing |
| | Fresh water | " | " | 6.0 | 3/5 | " | Self-extinguishing |
| | Sea water | " | Acetone | 5.6 | 3/25 | " | Self-extinguishing |
| | Sea water | 4.5 | Propylene oxide | 5.7 | 4/7 | " | 19 |
| Comparative Example 1 | Sea water | 9 | iso-Propanol | 6.2 | Did not extinguish | — | — |
| | Fresh water | " | | 6.3 | Did not extinguish | — | — |
| 4 | Sea water | 3 | " | 6.2 | 3/14 | Did not ignite | 22 |
| | Fresh water | " | " | 6.3 | 3/33 | " | 19 |
| 5 | Sea water | " | " | 6.0 | 4/03 | " | 23 |

TABLE 3-continued

| Example | Dilution water | Dilution ratio (%) | Burning solvent | Foam expansion ratio | Extinguishing time (min./sec.) | Vapor sealing property (*1) | Heat resistance (*2) (cm ϕ) |
|---|---|---|---|---|---|---|---|
| | Fresh water | " | " | 6.3 | 4/13 | " | 22 |
| 6 | Sea water | " | " | 6.1 | 3/36 | " | 17 |
| | Fresh water | " | " | 6.2 | 3/33 | " | 18 |
| 7 | Sea water | " | " | 5.9 | 4/03 | " | 19 |
| | Fresh water | " | " | 6.2 | 3/49 | " | 19 |
| 8 | Sea water | " | " | 5.9 | 2/19 | " | 21 |
| | Fresh water | " | " | 6.3 | 2/46 | " | 24 |
| 9 | Sea water | " | Methanol | 5.8 | 3/09 | " | 20 |
| | Fresh water | " | " | 6.0 | 3/12 | " | 21 |
| 10 | Sea water | " | " | 5.7 | 3/42 | " | 15 |
| | Fresh water | " | " | 5.8 | 3/43 | " | 17 |
| 11 | Sea water | " | " | 5.6 | 3/22 | " | 19 |
| | Fresh water | " | " | 5.6 | 3/35 | " | 21 |
| 12 | Sea water | " | Acetone | 6.3 | 2/16 | " | 18 |
| | Fresh water | " | " | 6.4 | 2/19 | " | 18 |
| 13 | Sea water | " | " | 6.1 | 3/22 | " | 23 |
| | Fresh water | " | " | 6.0 | 3/33 | " | 23 |
| 14 | Sea water | " | " | 5.8 | 3/13 | " | 25 |
| | Fresh water | " | " | 6.3 | 3/17 | " | 26 |
| 15 | Sea water | " | " | 6.1 | 2/53 | " | 24 |
| | Fresh water | " | " | 5.7 | 2/34 | " | 21 |
| 16 | Sea water | " | iso-Propanol | 6.0 | 3/09 | " | 20 |
| | Fresh water | " | " | 6.1 | 3/18 | " | 25 |
| 17 | Sea water | " | " | 5.7 | 2/26 | " | 27 |
| | Fresh water | " | " | 5.9 | 2/33 | " | 26 |
| 18 | Sea water | " | " | 6.1 | 3/41 | " | 20 |
| | Fresh water | " | " | 6.0 | 3/47 | " | 19 |
| 19 | Sea water | 4.5 | Propylene oxide | 5.8 | 3/56 | " | 18 |
| | Fresh water | " | " | 5.7 | 3/48 | " | 23 |
| 20 | Sea water | " | " | 5.9 | 3/11 | " | 21 |
| | Fresh water | " | " | 6.0 | 3/21 | " | 18 |
| 21 | Sea water | 3 | Methanol | 5.7 | 3/40 | " | 19 |
| | Fresh water | " | " | 5.6 | 3/51 | " | 23 |
| 22 | Sea water | " | " | 5.9 | 3/21 | " | 19 |
| | Fresh water | " | " | 5.7 | 3/24 | " | 20 |
| 23 | Sea water | " | " | 5.9 | 3/36 | " | 23 |
| | Fresh water | " | " | 6.3 | 3/42 | " | 24 |
| 24 | Sea water | " | " | 6.1 | 3/16 | " | 25 |
| | Fresh water | " | " | 6.4 | 3/18 | " | 21 |
| 25 | Sea water | " | " | 5.8 | 4/06 | " | 22 |
| | Fresh water | " | " | 5.6 | 4/32 | " | 24 |
| 26 | Sea water | " | Acetone | 6.3 | 2/38 | " | 22 |
| | Fresh water | " | " | 6.1 | 2/44 | " | 24 |
| 27 | Sea water | " | " | 6.2 | 2/56 | " | 21 |
| | Fresh water | " | " | 6.4 | 3/08 | " | 20 |
| 28 | Sea water | " | iso-Propanol | 5.8 | 4/01 | " | 20 |
| | Fresh water | " | " | 5.7 | 4/22 | " | 20 |
| 29 | Sea water | " | " | 5.3 | 3/06 | " | 18 |
| | Fresh water | " | " | 5.5 | 3/18 | " | 18 |
| 30 | Sea water | " | " | 5.7 | 3/13 | " | 19 |
| | Fresh water | " | " | 5.9 | 3/56 | " | 16 |
| 31 | Sea water | " | Acetone | 6.0 | 3/17 | " | 23 |
| | Fresh water | " | " | 5.9 | 3/19 | " | 21 |
| 32 | Sea water | " | " | 6.1 | 3/06 | " | 18 |
| | Fresh water | " | " | 5.8 | 3/33 | " | 17 |
| 33 | Sea water | " | " | 5.7 | 3/42 | " | 18 |
| | Fresh water | " | " | 5.6 | 3/56 | " | 20 |
| 34 | Sea water | " | Methanol | 5.8 | 3.52 | " | 18 |
| | Fresh water | " | " | 5.9 | 3/50 | " | 19 |
| 35 | Sea water | " | " | 6.0 | 3/48 | " | 22 |
| | Fresh water | " | " | 6.1 | 3/49 | " | 24 |
| 36 | Sea water | " | " | 6.2 | 3/33 | " | 21 |
| | Fresh water | " | " | 6.3 | 3/16 | " | 26 |
| 37 | Sea water | " | " | 6.4 | 3/15 | " | 23 |
| | Fresh water | " | " | 6.6 | 3/10 | " | 24 |
| 38 | Sea water | " | " | 5.4 | 3/20 | " | 21 |
| | Fresh water | " | " | 5.3 | 3/29 | " | 24 |
| 39 | Sea water | " | " | 5.7 | 3/51 | " | 25 |
| | Fresh water | " | " | 5.6 | 3/57 | " | 26 |
| 40 | Sea water | " | Acetone | 5.9 | 3/19 | " | 18 |
| | Fresh water | " | " | 5.6 | 4/00 | " | 19 |
| 41 | Sea water | " | " | 5.8 | 3/44 | " | 20 |
| | Fresh water | " | " | 5.8 | 3/38 | " | 21 |
| 42 | Sea water | " | " | 5.9 | 3/48 | " | 26 |
| | Fresh water | " | " | 5.5 | 3/25 | " | 25 |
| 43 | Sea water | " | iso-Propanol | 6.0 | 3/18 | " | 23 |
| | Fresh water | " | " | 6.1 | 3/31 | " | 22 |
| 44 | Sea water | 4.5 | Propylene oxide | 5.3 | 2/16 | " | 19 |
| | Fresh water | " | " | 5.4 | 2/19 | " | 18 |

TABLE 3-continued

| Example | Dilution water | Dilution ratio (%) | Burning solvent | Foam expansion ratio | Extinguishing time (min./sec.) | Vapor sealing property (*1) | Heat resistance (*2) (cm $\phi$) |
|---|---|---|---|---|---|---|---|
| 45 | Sea water | 3 | Methanol | 6.0 | 3/26 | " | 21 |
| | Fresh water | " | " | 6.1 | 3/24 | " | 20 |
| 46 | Sea water | " | " | 5.6 | 3/19 | " | 20 |
| | Fresh water | " | " | 5.8 | 3/17 | " | 19 |
| 47 | Sea water | " | " | 5.9 | 3/19 | " | 18 |
| | Fresh water | " | " | 5.8 | 3/42 | " | 17 |
| 48 | Sea water | 4.5 | Propylene oxide | 6.1 | 2/00 | " | 19 |
| | Fresh water | " | " | 6.3 | 2/32 | " | 20 |
| 49 | Sea water | 3 | Methanol | 6.1 | 3/16 | " | 18 |
| | Fresh water | " | " | 6.0 | 3/19 | " | 20 |
| 50 | Sea water | " | " | 5.8 | 3/18 | " | 21 |
| | Fresh water | " | " | 5.7 | 3/32 | " | 22 |
| 51 | Sea water | " | " | 5.7 | 3/54 | " | 24 |
| | Fresh water | " | " | 5.9 | 3/06 | " | 25 |
| 52 | Sea water | " | " | 6.0 | 3/47 | " | 24 |
| | Fresh water | " | " | 5.8 | 3/16 | " | 25 |
| 53 | Sea water | " | " | 5.7 | 3/37 | " | 26 |
| | Fresh water | " | " | 5.3 | 3/26 | " | 23 |
| 54 | Sea water | " | " | 6.1 | 3/36 | " | 27 |
| | Fresh water | " | " | 6.3 | 3/18 | " | 27 |
| 55 | Sea water | " | " | 6.0 | 3/46 | " | 25 |
| | Fresh water | " | " | 6.0 | 3/14 | " | 25 |
| 56 | Sea water | " | iso-Propanol | 5.6 | 4/07 | " | 20 |
| | Fresh water | " | " | 5.7 | 4/06 | " | 26 |
| 57 | Sea water | " | " | 5.9 | 3/58 | " | 27 |
| | Fresh water | " | " | 5.8 | 3/42 | " | 26 |
| 58 | Sea water | " | " | 5.9 | 3/53 | " | 25 |
| | Fresh water | " | " | 5.7 | 3/55 | " | 24 |
| 59 | Sea water | " | Acetone | 6.0 | 3/11 | " | 27 |
| | Fresh water | " | " | 6.1 | 3/12 | " | 28 |
| 60 | Sea water | " | " | 5.9 | 3/31 | " | 21 |
| | Fresh water | " | " | 6.3 | 3/27 | " | 20 |
| 61 | Sea water | " | " | 5.8 | 3/24 | " | 23 |
| | Fresh water | " | " | 5.9 | 3/22 | " | 20 |
| 62 | Sea water | " | " | 5.5 | 3/18 | " | 21 |
| | Fresh water | " | " | 5.6 | 3/16 | " | 22 |
| 63 | Sea water | " | " | 5.8 | 3/14 | " | 24 |
| | Fresh water | " | " | 6.0 | 3/18 | " | 23 |
| 64 | Sea water | " | Methanol | 5.6 | 3/43 | " | 24 |
| | Fresh water | " | " | 5.7 | 3/14 | " | 23 |
| 65 | Sea water | " | " | 5.5 | 3/17 | " | 24 |
| | Fresh water | " | " | 5.7 | 3/19 | " | 21 |
| 66 | Sea water | " | " | 5.6 | 4/03 | " | 24 |
| | Fresh water | " | " | 6.0 | 3/59 | " | 22 |
| 67 | Sea water | " | " | 5.8 | 3/19 | " | 23 |
| | Fresh water | " | " | 5.8 | 3/26 | " | 19 |
| 68 | Sea water | " | " | 5.9 | 3/34 | " | 22 |
| | Fresh water | " | " | 5.6 | 3/38 | " | 19 |
| 69 | Sea water | " | " | 5.5 | 3/20 | " | 20 |
| | Fresh water | " | " | 5.4 | 3/17 | " | 21 |
| 70 | Sea water | " | Acetone | 6.0 | 3/08 | " | 19 |
| | Fresh water | " | " | 6.1 | 3/11 | " | 18 |
| 71 | Sea water | 4.5 | Propylene oxide | 6.3 | 2/46 | " | 18 |
| | Fresh water | " | " | 6.4 | 2/33 | " | 19 |
| 72 | Sea water | " | " | 6.7 | 2/16 | " | 18 |
| | Fresh water | " | " | 6.5 | 2/30 | " | 20 |
| 73 | Sea water | 3 | iso-Propanol | 5.6 | 3/44 | " | 25 |
| | Fresh water | " | " | 5.4 | 3/56 | " | 26 |
| 74 | Sea water | 4.5 | Propylene oxide | 6.1 | 2/11 | " | 18 |
| | Fresh water | " | " | 6.2 | 2/40 | " | 21 |
| 75 | Sea water | 3 | Acetone | 5.8 | 3/12 | " | 21 |
| | Fresh water | " | " | 5.9 | 3/19 | " | 22 |
| 76 | Sea water | " | iso-Propanol | 5.7 | 3/49 | " | 20 |
| | Fresh water | " | " | 5.7 | 3/55 | " | 19 |
| 77 | Sea water | " | " | 5.8 | 3/18 | " | 21 |
| | Fresh water | " | " | 5.9 | 3/19 | " | 22 |
| 78 | Sea water | " | " | 5.7 | 3/20 | " | 23 |
| | Fresh water | " | " | 5.6 | 3/37 | " | 24 |
| 79 | Sea water | " | " | 5.6 | 3/39 | " | 21 |
| | Fresh water | " | " | 5.7 | 3/42 | " | 26 |
| 80 | Sea water | " | Acetone | 5.9 | 3/55 | " | 25 |
| | Fresh water | " | " | 6.0 | 3/46 | " | 25 |
| 81 | Sea water | " | " | 6.0 | 3/56 | " | 24 |
| | Fresh water | " | " | 5.8 | 3/33 | " | 24 |
| 82 | Sea water | " | Methanol | 6.1 | 3/12 | " | 21 |
| | Fresh water | " | " | 6.0 | 3/06 | " | 22 |
| 83 | Sea water | " | " | 6.2 | 3/09 | " | 20 |
| | Fresh water | " | " | 6.0 | 3/13 | " | 19 |
| 84 | Sea water | " | iso-Propanol | 5.8 | 3/23 | " | 20 |

TABLE 3-continued

| Example | Dilution water | Dilution ratio (%) | Burning solvent | Foam expansion ratio | Extinguishing time (min./sec.) | Vapor sealing property (*1) | Heat resistance (*2) (cm ϕ) |
|---|---|---|---|---|---|---|---|
| | Fresh water | " | " | 5.7 | 3/16 | " | 19 |
| 85 | Sea water | " | " | 5.9 | 3/15 | " | 18 |
| | Fresh water | " | " | 5.9 | 3/06 | " | 19 |
| 86 | Sea water | 4.5 | Methanol | 6.0 | 3/56 | " | 16 |
| | Fresh water | " | " | 6.2 | 3/54 | " | 17 |
| 87 | Sea water | " | " | 6.0 | 3/49 | " | 19 |
| | Fresh water | " | " | 5.7 | 3/46 | " | 22 |
| 88 | Sea water | 3 | Acetone | 5.6 | 3/18 | " | 23 |
| | Fresh water | " | " | 5.7 | 3/49 | " | 26 |
| 89 | Sea water | " | " | 5.9 | 3/14 | " | 25 |
| | Fresh water | " | " | 6.0 | 3/23 | " | 24 |
| 90 | Sea water | 4.5 | Propylene oxide | 6.3 | 2/19 | " | 27 |
| | Fresh water | " | " | 6.4 | 2/13 | " | 22 |
| 91 | Sea water | " | " | 6.2 | 2/31 | " | 26 |
| | Fresh water | " | " | 6.0 | 2/33 | " | 23 |
| 92 | Sea water | 3 | Acetone | 5.9 | 3/43 | " | 21 |
| | Fresh water | " | " | 5.7 | 3/41 | " | 23 |
| 93 | Sea water | " | Methanol | 5.6 | 3/56 | " | 22 |
| | Fresh water | " | " | 5.7 | 4/02 | " | 23 |
| 94 | Sea water | " | " | 5.5 | 3/42 | " | 19 |
| | Fresh water | " | " | 5.7 | 3/16 | " | 19 |
| 95 | Sea water | " | " | 5.9 | 3/35 | " | 19 |
| | Fresh water | " | " | 5.8 | 3/32 | " | 20 |
| 96 | Sea water | " | " | 5.9 | 3/31 | " | 22 |
| | Fresh water | " | " | 6.0 | 3/56 | " | 24 |
| 97 | Sea water | " | " | 5.7 | 3/12 | " | 23 |
| | Fresh water | " | " | 5.7 | 3/16 | " | 22 |
| 98 | Sea water | " | " | 5.5 | 3/19 | " | 20 |
| | Fresh water | " | " | 5.9 | 3/21 | " | 21 |
| 99 | Sea water | " | " | 6.0 | 3/29 | " | 19 |
| | Fresh water | " | " | 5.7 | 3/32 | " | 20 |
| 100 | Sea water | " | iso-Propanol | 5.3 | 3/52 | " | 22 |
| | Fresh water | " | " | 5.5 | 3/48 | " | 23 |

(*1): Vapor sealing property
For 15 minutes after the application of the fire extinguisher, a flame was made to approach the foam surface by using a torch, and it was determined whether the solvent caught fire.
(*2): Heat resistance
Fifteen minutes after the application of the fire extinguisher, a liquid surface of a square shape with one side measuring 15 cm was exposed at the central part of the foam surface. It was ignited, and the burning area was measured 5 minutes later.

EXAMPLES 101 TO 195

| | |
|---|---|
| Surface-active agent (A-1 to A-4) | 3% |
| Cationic water-soluble polymer (B-I to B-VIII) | 6% |
| Polybasic acid (C-1 to C-32) | 4% |
| Ethylene glycol | 15% |
| Butyl carbitol | 15% |

-continued

| | |
|---|---|
| Water | 57% |

In each run, a fire extinguisher was prepared in accordance with the above formulation containing the polybasic acid, and tested in the same way as in Examples 1 to 100. The properties of the resulting fire extinguishers are shown in Table 4, and the results of the fire extinguishing test are shown in Table 5.

TABLE 4

| Example | Surface-active agent (A) | Cationic water-soluble polymer (B) | Polybasic acid | Appearance | Freezing point (°C.) | Viscosity at −10° C. (cst) | Test for the amount of a precipitate (*1) |
|---|---|---|---|---|---|---|---|
| 101 | A-1-a | I | C-1 (n = 4) | Completely clear | −15 | 156 | Trace |
| 102 | A-1-c | I | " | " | −15 | 150 | " |
| 103 | A-1-d | I | " | " | −13 | 160 | " |
| 104 | A-1-m | I | " | " | −14 | 172 | " |
| 105 | A-1-p | I | " | " | −14 | 163 | " |
| 106 | A-1-r | I | C-1 (n = 6) | " | −16 | 162 | " |
| 107 | A-1-t | I | " | " | −14 | 165 | " |
| 108 | A-1-u | I | " | " | −14 | 164 | " |
| 109 | A-1-v | I | " | " | −14 | 167 | " |
| 110 | A-1-b | II-(a) | C-2 | " | −14 | 166 | " |
| 111 | A-1-e | II-(b) | " | " | −15 | 172 | " |
| 112 | A-1-f | II-(c) | " | " | −16 | 163 | " |
| 113 | A-1-g | II-(a) | C-4 | " | −16 | 162 | " |
| 114 | A-1-h | II-(a) | " | " | −16 | 176 | " |
| 115 | A-1-j | II-(b) | " | " | −14 | 179 | " |
| 116 | A-1-k | II-(b) | C-3 | " | −15 | 167 | " |
| 117 | A-1-n | II-(c) | " | " | −13 | 169 | " |
| 118 | A-1-o | I | " | " | −13 | 170 | " |
| 119 | A-1-s | I | C-8 | " | −12 | 180 | " |
| 120 | A-1-c | II-(a) | C-6 | " | −13 | 165 | " |

TABLE 4-continued

| Example | Surface-active agent (A) | Cationic water-soluble polymer (B) | Polybasic acid | Appearance | Freezing point (°C.) | Viscosity at −10° C. (cst) | Test for the amount of a precipitate (*1) |
|---|---|---|---|---|---|---|---|
| 121 | A-1-c | III | C-8 | " | −14 | 170 | " |
| 122 | A-1-c | IV | C-10 | " | −15 | 171 | " |
| 123 | A-1-c | V | C-9 | " | −16 | 173 | " |
| 124 | A-1-c | VII | C-7 | " | −16 | 165 | " |
| 125 | A-1-c | VIII | " | " | −15 | 166 | " |
| 126 | A-1-d | III | " | " | −14 | 170 | " |
| 127 | A-1-m | IV | C-13 | " | −14 | 175 | " |
| 128 | A-1-r | V | C-15 | " | −15 | 176 | " |
| 129 | A-1-t | VII | C-16 | " | −14 | 173 | " |
| 130 | A-1-u | VI | C-20 | " | −15 | 180 | " |
| 131 | A-1-v | VIII | C-22 | " | −16 | 180 | " |
| 132 | A-2-a | I | C-23 | " | −14 | 180 | " |
| 133 | A-2-c | I | C-1 (n = 4) | " | −17 | 179 | " |
| 134 | A-2-d | I | " | " | −11 | 179 | " |
| 135 | A-2-f | I | C-25 | " | −13 | 169 | " |
| 136 | A-2-h | I | C-24 | " | −16 | 173 | " |
| 137 | A-2-i | I | " | " | −16 | 172 | " |
| 138 | A-2-j | I | " | " | −15 | 173 | " |
| 139 | A-2-k | I | " | " | −16 | 175 | " |
| 140 | A-2-l | I | C-30 (p = 4) | " | −16 | 176 | " |
| 141 | A-2-n | I | " | " | −14 | 179 | " |
| 142 | A-2-o | I | C-31 (q = 2) | " | −14 | 180 | " |
| 143 | A-2-a | II-(a) | " | " | −14 | 173 | " |
| 144 | A-2-f | II-(b) | C-27 | " | −14 | 174 | " |
| 145 | A-2-g | II-(a) | C-28 | " | −14 | 175 | " |
| 146 | A-2-m | II-(b) | C-19 (n = 4) | " | −14 | 176 | " |
| 147 | A-2-o | II-(a) | C-24 | " | −15 | 176 | " |
| 148 | A-2-c | II-(a) | C-1 (n = 6) | " | −15 | 182 | " |
| 149 | A-2-c | III | " | " | −16 | 183 | " |
| 150 | A-2-c | IV | " | " | −16 | 183 | " |
| 151 | A-2-c | V | " | " | −16 | 180 | " |
| 152 | A-2-c | VI | C-16 | " | −15 | 186 | " |
| 153 | A-2-c | VII | " | " | −16 | 172 | " |
| 154 | A-2-c | VIII | " | " | −15 | 173 | " |
| 155 | A-2-e | VI | C-10 | " | −16 | 171 | " |
| 156 | A-2-i | VII | " | " | −13 | 176 | " |
| 157 | A-2-k | V | " | " | −13 | 175 | " |
| 158 | A-2-n | IV | " | " | −13 | 175 | " |
| 159 | A-3-a | I | C-13 | " | −13 | 175 | " |
| 160 | A-3-b | I | " | " | −15 | 176 | " |
| 161 | A-3-d | I | " | " | −13 | 175 | " |
| 162 | A-3-f | I | C-17 | " | −14 | 176 | " |
| 163 | A-3-h | I | " | " | −14 | 182 | " |
| 164 | A-3-i | I | " | " | −10 | 175 | " |
| 165 | A-3-k | I | C-18 | " | −13 | 176 | " |
| 166 | A-3-c | II-(b) | C-7 | " | −12 | 175 | " |
| 167 | A-3-d | II-(b) | " | " | −13 | 175 | " |
| 168 | A-3-e | II-(a) | C-14 | " | −12 | 176 | " |
| 169 | A-3-g | II-(c) | C-22 | " | −12 | 170 | " |
| 170 | A-3-j | II-(c) | C-23 | " | −13 | 173 | " |
| 171 | A-3-b | III | C-26 | " | −15 | 176 | " |
| 172 | A-3-b | III | C-27 | " | −12 | 165 | " |
| 173 | A-3-b | V | " | " | −14 | 165 | " |
| 174 | A-3-b | VI | " | " | −13 | 170 | " |
| 175 | A-3-b | VII | C-29 (l = 4) | " | −12 | 172 | " |
| 176 | A-3-b | VIII | C-31 (q = 4) | " | −15 | 182 | " |
| 177 | A-3-c | V | " | " | −14 | 170 | " |
| 178 | A-3-f | IV | " | " | −12 | 163 | " |
| 179 | A-3-h | VI | C-28 | " | −12 | 160 | " |
| 180 | A-3-j | VII | C-24 | " | −15 | 180 | " |
| 181 | A-4-a | I | " | " | −16 | 153 | " |
| 182 | A-4-b | I | " | " | −14 | 150 | " |
| 183 | A-4-c | I | " | " | −15 | 160 | " |
| 184 | A-4-d | I | C-16 | " | −14 | 152 | " |
| 185 | A-4-e | I | C-14 | " | −16 | 156 | " |
| 186 | A-4-f | I | " | " | −15 | 160 | " |
| 187 | A-4-g | I | " | " | −15 | 153 | " |
| 188 | A-4-b | II-(a) | C-12 (P-type) | " | −14 | 154 | " |
| 189 | A-4-c | II-(b) | C-10 | " | −13 | 157 | " |
| 190 | A-4-d | II-(c) | " | " | −15 | 159 | " |
| 191 | A-4-f | III | " | " | −14 | 172 | " |
| 192 | A-4-g | IV | C-2 | " | −14 | 172 | " |
| 193 | A-4-c | III | C-1 (n = 4) | " | −15 | 155 | " |
| 194 | A-4-c | IV | " | " | −14 | 160 | " |
| 195 | A-4-c | VII | " | " | −14 | 163 | " |

(*1): Same as the footnote to Table 2.

TABLE 5

| Example | Dilution water | Dilution ratio (%) | Burning solvent | Foam expansion ratio | Extinguishing time (min./sec.) | Vapor sealing property (*1) | Heat resistance (*2) (cm ϕ) |
|---|---|---|---|---|---|---|---|
| 101 | Sea water | 3 | iso-Propanol | 6.3 | 2/16 | Did not ignite | 11 |
| | Fresh water | " | " | 6.4 | 2/56 | " | 9 |
| 102 | Sea water | " | " | 6.2 | 3/42 | " | 4 |
| | Fresh water | " | " | 6.3 | 3/43 | " | 6 |
| 103 | Sea water | " | " | 6.2 | 2/18 | " | 3 |
| | Fresh water | " | " | 6.4 | 2/19 | " | 3 |
| 104 | Sea water | " | " | 6.3 | 3/12 | " | 8 |
| | Fresh water | " | " | 6.4 | 3/19 | " | 8 |
| 105 | Sea water | " | " | 6.6 | 1/56 | " | 11 |
| | Fresh water | " | " | 6.7 | 1/58 | " | 13 |
| 106 | Sea water | " | Methanol | 6.3 | 2/23 | " | 16 |
| | Fresh water | " | " | 6.7 | 2/29 | " | 14 |
| 107 | Sea water | " | " | 6.0 | 2/59 | " | 13 |
| | Fresh water | " | " | 6.1 | 2/48 | " | 12 |
| 108 | Sea water | " | " | 6.0 | 2/46 | " | 17 |
| | Fresh water | " | " | 6.3 | 2/48 | " | 13 |
| 109 | Sea water | " | Acetone | 6.7 | 2/00 | " | 9 |
| | Fresh water | " | " | 2/56 | 1/59 | "8 | 8 |
| 110 | Sea water | " | " | 6.6 | 2/33 | " | 5 |
| | Fresh water | " | " | 6.3 | 2/48 | " | 6 |
| 111 | Sea water | " | " | 6.0 | 2/35 | " | 5 |
| | Fresh water | " | " | 6.5 | 2/58 | " | 3 |
| 112 | Sea water | " | " | 6.4 | 2/13 | " | 7 |
| | Fresh water | " | " | 6.1 | 2/00 | " | 8 |
| 113 | Sea water | " | iso-Propanol | 6.3 | 2/32 | " | 15 |
| | Fresh water | " | " | 6.4 | 2/48 | " | 13 |
| 114 | Sea water | " | " | 6.0 | 2/01 | " | 14 |
| | Fresh water | " | " | 6.1 | 2/13 | " | 10 |
| 115 | Sea water | " | " | 6.4 | 2/26 | " | 10 |
| | Fresh water | " | " | 6.3 | 2/58 | " | 8 |
| 116 | Sea water | 4.5 | Propylene oxide | 6.3 | 2/59 | " | 7 |
| | Fresh water | " | " | 6.2 | 3/07 | " | 10 |
| 117 | Sea water | " | " | 6.7 | 2/23 | " | 11 |
| | Fresh water | " | " | 6.8 | 2/21 | " | 9 |
| 118 | Sea water | 3 | Methanol | 6.9 | 2/59 | " | 9 |
| | Fresh water | " | " | 6.3 | 2/53 | " | 7 |
| 119 | Sea water | " | " | 6.6 | 2/18 | " | 9 |
| | Fresh water | " | " | 6.5 | 2/32 | " | 10 |
| 120 | Sea water | " | " | 6.7 | 2/46 | " | 11 |
| | Fresh water | " | " | 6.3 | 2/48 | " | 13 |
| 121 | Sea water | " | " | 6.5 | 2/33 | " | 14 |
| | Fresh water | " | " | 6.5 | 2/30 | " | 10 |
| 122 | Sea water | " | " | 6.3 | 3/18 | " | 10 |
| | Fresh water | " | " | 6.0 | 3/43 | " | 8 |
| 123 | Sea water | " | Acetone | 6.7 | 2/00 | " | 9 |
| | Fresh water | " | " | 6.5 | 2/16 | " | 10 |
| 124 | Sea water | " | " | 6.5 | 1/58 | " | 9 |
| | Fresh water | " | " | 6.6 | 1/53 | " | 8 |
| 125 | Sea water | " | iso-Propanol | 6.0 | 3/11 | " | 9 |
| | Fresh water | " | " | 5.9 | 3/23 | " | 9 |
| 126 | Sea water | " | " | 5.9 | 2/16 | " | 6 |
| | Fresh water | " | " | 6.0 | 2/22 | " | 6 |
| 127 | Sea water | " | " | 6.3 | 2/00 | " | 7 |
| | Fresh water | " | " | 6.5 | 2/13 | " | 6 |
| 128 | Sea water | " | Acetone | 6.9 | 2/00 | " | 7 |
| | Fresh water | " | " | 6.8 | 1/58 | " | 8 |
| 129 | Sea water | " | " | 6.9 | 1/56 | " | Self-extinguishing |
| | Fresh water | " | " | 6.5 | 2/17 | " | Self-extinguishing |
| 130 | Sea water | " | " | 6.7 | 2/58 | " | Self-extinguishing |
| | Fresh water | " | " | 6.6 | 2/57 | " | 3 |
| 131 | Sea water | " | Methanol | 6.7 | 3/08 | " | 3 |
| | Fresh water | " | " | 6.6 | 3/00 | " | 2 |
| 132 | Sea water | " | " | 6.8 | 3/11 | " | 10 |
| | Fresh water | " | " | 6.7 | 3/12 | " | 11 |
| 133 | Sea water | " | " | 6.9 | 2/58 | " | 10 |
| | Fresh water | " | " | 7.0 | 2/48 | " | 15 |
| 134 | Sea water | " | " | 7.1 | 2/13 | " | 12 |
| | Fresh water | " | " | 7.1 | 2/15 | " | 10 |
| 135 | Sea water | " | " | 6.6 | 2.48 | " | 10 |
| | Fresh water | " | " | 6.7 | 2/56 | " | 12 |
| 136 | Sea water | " | " | 6.5 | 2/56 | " | 13 |
| | Fresh water | " | " | 6.0 | 2/56 | " | 12 |
| 137 | Sea water | " | Acetone | 6.3 | 3/01 | " | 9 |
| | Fresh water | " | " | 6.2 | 3/48 | " | 8 |
| 138 | Sea water | " | " | 6.6 | 2/58 | " | 10 |
| | Fresh water | " | " | 6.6 | 2/46 | " | 11 |

TABLE 5-continued

| Example | Dilution water | Dilution ratio (%) | Burning solvent | Foam expansion ratio | Extinguishing time (min./sec.) | Vapor sealing property (*1) | Heat resistance (*2) (cm ϕ) |
|---|---|---|---|---|---|---|---|
| 139 | Sea water | " | " | 6.8 | 3/16 | " | 9 |
| | Fresh water | " | " | 6.5 | 2/46 | " | 9 |
| 140 | Sea water | " | iso-Propanol | 6.8 | 2/46 | " | 9 |
| | Fresh water | " | " | 6.9 | 2/45 | " | 9 |
| 141 | Sea water | 4.5 | Propylene oxide | 6.3 | 1/46 | " | 10 |
| | Fresh water | " | " | 6.5 | 1/33 | " | 10 |
| 142 | Sea water | 3 | Methanol | 7.0 | 2/11 | " | 8 |
| | Fresh water | " | " | 7.2 | 2/06 | " | 8 |
| 143 | Sea water | " | " | 6.0 | 2/27 | " | 9 |
| | Fresh water | " | " | 6.5 | 2/16 | " | 2/48 |
| 144 | Sea water | " | " | 6.9 | 2/52 | " | Self-extinguishing |
| | Fresh water | " | " | 7.0 | 2/52 | " | Self-extinguishing |
| | | | 2/59 | | | | |
| 145 | Sea water | 4.5 | Propylene oxide | 7.1 | /59 | " | 11 |
| | Fresh water | " | " | 6.9 | /57 | " | 9 |
| 146 | Sea water | 3 | Methanol | 7.0 | 1/16 | " | 2 |
| | Fresh water | " | " | 6.6 | 1/28 | " | 4 |
| 147 | Sea water | " | " | 6.3 | 2/32 | " | 6 |
| | Fresh water | " | " | 6.7 | 2/46 | " | 4 |
| 148 | Sea water | " | " | 6.6 | 2/59 | " | 8 |
| | Fresh water | " | " | 6.9 | 2/13 | " | 8 |
| 149 | Sea water | " | " | 6.6 | 2/33 | " | Self-extinguishing |
| | Fresh water | " | " | 6.5 | 1/53 | " | Self-extinguishing |
| 150 | Sea water | " | " | 6.6 | 2/16 | " | Self-extinguishing |
| | Fresh water | " | " | 6.4 | 2/33 | " | Self-extinguishing |
| 151 | Sea water | " | " | 7.2 | 2/42 | " | 3 |
| | Fresh water | " | " | 7.5 | 2/17 | " | 4 |
| 152 | Sea water | " | " | 7.2 | 2/32 | " | 5 |
| | Fresh water | " | " | 7.2 | 1/59 | " | 8 |
| 153 | Sea water | " | iso-Propanol | 6.9 | 3/13 | " | 8 |
| | Fresh water | " | " | 7.0 | 3/18 | " | 10 |
| 154 | Sea water | " | " | 7.0 | 3/01 | " | 8 |
| | Fresh water | " | " | 7.1 | 3/06 | " | 12 |
| 155 | Sea water | " | " | 7.3 | 3/00 | " | 13 |
| | Fresh water | " | " | 7.2 | 2/47 | " | 12 |
| 156 | Sea water | " | Acetone | 7.3 | 2/11 | " | 11 |
| | Fresh water | " | " | 7.4 | 2/10 | " | 13 |
| 157 | Sea water | " | " | 7.0 | 2/53 | " | 9 |
| | Fresh water | " | " | 6.9 | 2/56 | " | 8 |
| 158 | Sea water | " | " | 7.3 | 2/22 | " | 7 |
| | Fresh water | " | " | 7.6 | 2/18 | " | 7 |
| 159 | Sea water | " | " | 7.5 | 2/19 | " | 8 |
| | Fresh water | " | " | 7.4 | 2/24 | " | 9 |
| 160 | Sea water | " | " | 7.6 | 2/29 | " | 10 |
| | Fresh water | " | " | 7.0 | 2/38 | " | 10 |
| 161 | Sea water | " | Methanol | 6.3 | 2/38 | " | 11 |
| | Fresh water | " | " | 6.6 | 2/56 | " | 12 |
| 162 | Sea water | " | " | 6.5 | 2/48 | " | 13 |
| | Fresh water | " | " | 6.7 | 2/32 | " | 13 |
| 163 | Sea water | " | " | 6.6 | 2/39 | " | 12 |
| | Fresh water | " | " | 6.8 | 2/56 | " | 11 |
| 164 | Sea water | " | " | 6.7 | 2/48 | " | 13 |
| | Fresh water | " | " | 6.7 | 2/27 | " | 8 |
| 165 | Sea water | " | " | 6.6 | 2/36 | " | 9 |
| | Fresh water | " | " | 6.7 | 2/39 | " | 9 |
| 166 | Sea water | " | " | 6.5 | 2/16 | " | 10 |
| | Fresh water | " | " | 6.4 | 2/19 | " | 11 |
| 167 | Sea water | " | Acetone | 7.6 | 2/00 | " | Self-extinguishing |
| | Fresh water | " | " | 7.3 | 1/56 | " | Self-extinguishing |
| 168 | Sea water | 4.5 | Propylene oxide | 8.0 | 1/12 | " | 11 |
| | Fresh water | " | " | 8.3 | 1/13 | " | 10 |
| 169 | Sea water | " | " | 8.0 | 1/07 | " | 10 |
| | Fresh water | " | " | 7.9 | /53 | " | 8 |
| 170 | Sea water | 3 | iso-Propanol | 6.3 | 2/57 | " | 13 |
| | Fresh water | " | " | 6.2 | 2/49 | " | 12 |
| 171 | Sea water | 4.5 | Propylene oxide | 8.0 | 1/13 | " | 8 |
| | Fresh water | " | " | 7.9 | 1/27 | " | 10 |
| 172 | Sea water | 3 | Acetone | 6.6 | 2/16 | " | 11 |
| | Fresh water | " | " | 6.3 | 2/17 | " | 10 |
| 173 | Sea water | " | iso-Propanol | 6.3 | 3/00 | " | 10 |
| | Fresh water | " | " | 6.2 | 3/11 | " | 9 |
| 174 | Sea water | " | " | 6.7 | 2/49 | " | 8 |

TABLE 5-continued

| Example | Dilution water | Dilution ratio (%) | Burning solvent | Foam expansion ratio | Extinguishing time (min./sec.) | Vapor sealing property (*1) | Heat resistance (*2) (cm $\phi$) |
|---|---|---|---|---|---|---|---|
| | Fresh water | " | " | 6.8 | 2/59 | " | 12 |
| 175 | Sea water | " | " | 6.2 | 2/16 | " | 11 |
| | Fresh water | " | " | 6.6 | 2/33 | " | 13 |
| 176 | Sea water | " | " | 6.7 | 2/46 | " | 10 |
| | Fresh water | " | " | 6.8 | 2/43 | " | 13 |
| 177 | Sea water | " | Acetone | 6.9 | 3/06 | " | 12 |
| | Fresh water | " | " | 7.0 | 3/11 | " | 11 |
| 178 | Sea water | " | " | 7.2 | 3/12 | " | 13 |
| | Fresh water | " | " | 7.1 | 3/00 | " | 12 |
| 179 | Sea water | " | Methanol | 6.9 | 2/48 | " | 10 |
| | Fresh water | " | " | 7.0 | 2/46 | " | 11 |
| 180 | Sea water | " | " | 7.1 | 2/18 | " | 10 |
| | Fresh water | " | " | 7.0 | 2/16 | " | 9 |
| 181 | Sea water | " | iso-Propanol | 6.6 | 2/23 | " | 8 |
| | Fresh water | " | " | 6.7 | 2/26 | " | 9 |
| 182 | Sea water | " | " | 6.9 | 2/27 | " | 7 |
| | Fresh water | " | " | 6.9 | 2/16 | " | 8 |
| 183 | Sea water | 4.5 | Methanol | 7.0 | 2.58 | " | 9 |
| | Fresh water | " | " | 7.2 | 2/56 | " | 6 |
| 184 | Sea water | " | " | 7.0 | 2/43 | " | 3 |
| | Fresh water | " | " | 7.0 | 2/47 | " | 2 |
| 185 | Sea water | 3 | Acetone | 6.6 | 2/16 | " | 12 |
| | Fresh water | " | " | 6.3 | 2/32 | " | 13 |
| 186 | Sea water | " | " | 6.7 | 2/14 | " | 9 |
| | Fresh water | " | " | 6.9 | 2/16 | " | 10 |
| 187 | Sea water | 4.5 | Propylene oxide | 7.8 | 1/27 | " | 10 |
| | Fresh water | " | " | 7.9 | 1/33 | " | 10 |
| 188 | Sea water | " | " | 7.3 | /52 | " | 9 |
| | Fresh water | " | " | 7.6 | /46 | " | 11 |
| 189 | Sea water | 3 | Acetone | 6.8 | 2/32 | " | 9 |
| | Fresh water | " | " | 6.9 | 2/56 | " | 9 |
| 190 | Sea water | " | Methanol | 7.2 | 2/48 | " | 11 |
| | Fresh water | " | " | 7.2 | 2/59 | " | 12 |
| 191 | Sea water | " | " | 7.3 | 2/37 | " | 10 |
| | Fresh water | " | " | 7.0 | 2/19 | " | 8 |
| 192 | Sea water | " | " | 6.6 | 2/46 | " | 9 |
| | Fresh water | " | " | 6.7 | 2/43 | " | 10 |
| 193 | Sea water | " | " | 6.9 | 2/18 | " | 7 |
| | Fresh water | " | " | 7.0 | 2/11 | " | 6 |
| 194 | Sea water | " | " | 6.9 | 2/28 | " | 9 |
| | Fresh water | " | " | 6.3 | 2/17 | " | 8 |
| 195 | Sea water | " | " | 6.5 | 2/32 | " | 7 |
| | Fresh water | " | " | 6.9 | 2/38 | " | 6 |

(*1) and (*2): Same as the footnote to Table 3.

EXAMPLES 196 TO 233

Some of the fire extinguishers obtained in the foregoing Examples were subjected to a liquid resistance test and a test of determing the time (drainage time) which elapsed until the foams were converted to liquid. The results are shown in Table 6.

TABLE 6

| Example | No. (*1) | Liquid resistance (*2) Time required until the foams completely disappeared (min./sec.) Methanol | iso-Propanol | Acetone | Drainage time (min./sec.) 25% | 50% | 75% |
|---|---|---|---|---|---|---|---|
| 196 | 4 | 5/12 | 4/11 | 6/18 | 3/11 | 7/32 | 22/56 |
| 197 | 10 | 5/46 | 4/08 | 6/19 | 3/31 | 7/18 | 22/48 |
| 198 | 15 | 5/52 | 4/11 | 6/32 | 3/26 | 7/56 | 22/32 |
| 199 | 19 | 5/11 | 4/18 | 6/34 | 3/46 | 7/31 | 22/16 |
| 200 | 24 | 4/53 | 3/53 | 6/48 | 3/52 | 7/33 | 22/18 |
| 201 | 28 | 5/16 | 4/52 | 6/13 | 2/48 | 7/48 | 22/22 |
| 202 | 43 | 5/18 | 5/48 | 6/23 | 3/31 | 7/11 | 22/23 |
| 203 | 46 | 5/43 | 5/43 | 6/56 | 3/18 | 7/08 | 22/26 |
| 204 | 58 | 5/52 | 4/47 | 6/57 | 3/17 | 7/16 | 22/31 |
| 205 | 62 | 6/48 | 4/56 | 6/16 | 3/16 | 7/51 | 22/33 |
| 206 | 66 | 5/22 | 4/57 | 6/19 | 3/19 | 7/51 | 22/18 |
| 207 | 67 | 5/17 | 5/33 | 6/21 | 3/08 | 7/32 | 22/52 |
| 208 | 80 | 5/26 | 4/51 | 6/36 | 3/33 | 7/38 | 23/53 |
| 209 | 85 | 5/56 | 4/53 | 6/33 | 3/39 | 7/29 | 22/18 |

TABLE 6-continued

| Example | No. (*1) | Liquid resistance (*2) Time required until the foams completely disappeared (min./sec.) Methanol | iso-Propanol | Acetone | Drainage time (min./sec.) 25% | 50% | 75% |
|---|---|---|---|---|---|---|---|
| 210 | 87 | 5/18 | 4/59 | 6/31 | 3/56 | 7/38 | 24/19 |
| 211 | 90 | 6/20 | 4/41 | 6/30 | 3/51 | 7/21 | 22/27 |
| 212 | 100 | 6/19 | 4/47 | 6/19 | 3/44 | 7/24 | 25/32 |
| 213 | 110 | >10 min. | 8/11 | >10 min. | 5/56 | 10/53 | 40/17 |
| 214 | 113 | >10 min. | 8/56 | >10 min. | 5/47 | 10/52 | 39/16 |
| 215 | 118 | >10 min. | 7/32 | >10 min. | 6/11 | 10/56 | 39/46 |
| 216 | 120 | >10 min. | 7/49 | >10 min. | 6/13 | 10/18 | 38/41 |
| 217 | 125 | >10 min. | 8/56 | >10 min. | 6/16 | 10/23 | 41/33 |
| 218 | 131 | >10 min. | 9/13 | >10 min. | 6/13 | 10/29 | 42/37 |
| 219 | 134 | >10 min. | 9/59 | >10 min. | 6/08 | 10/16 | 43/19 |
| 220 | 145 | >10 min. | 7/16 | >10 min. | 6/14 | 11/46 | 42/19 |
| 221 | 148 | >10 min. | 8/42 | >10 min. | 6/17 | 11/21 | 41/17 |
| 222 | 152 | >10 min. | 9/53 | >10 min. | 6/28 | 12/19 | 46/18 |
| 223 | 156 | >10 min. | 7/48 | >10 min. | 6/29 | 13/21 | 45/21 |
| 224 | 159 | >10 min. | 9/16 | >10 min. | 6/38 | 12/18 | 43/38 |
| 225 | 160 | >10 min. | 8/16 | >10 min. | 6/43 | 11/33 | 40/39 |
| 226 | 167 | >10 min. | 7/47 | >10 min. | 6/12 | 11/42 | 39/42 |
| 227 | 173 | >10 min. | 8/51 | >10 min. | 5/19 | 11/47 | 41/44 |
| 228 | 180 | >10 min. | 7/14 | >10 min. | 5/31 | 11/46 | 46/47 |
| 229 | 182 | >10 min. | 8/14 | >10 min. | 6/42 | 11/50 | 48/16 |
| 230 | 183 | >10 min. | 9/46 | >10 min. | 5/47 | 11/31 | 49/21 |
| 231 | 188 | >10 min. | 8/33 | >10 min. | 6/51 | 11/40 | 40/27 |
| 232 | 190 | >10 min. | 7/26 | >10 min. | 6/51 | 11/16 | 39/35 |

TABLE 6-continued

| Example | No. (*1) | Liquid resistance (*2) Time required until the foams completely disappeared (min./sec.) Methanol | iso-Propanol | Acetone | Drainage time (min./sec.) 25% | 50% | 75% |
|---|---|---|---|---|---|---|---|
| 233 | 191 | >10 min. | 9/27 | >10 min. | 5/48 | 10/10 | 40/55 |

(*1): Showing the fire extinguishers by the numbers of the foregoing Examples.
(*2): The liquid resistance was tested by the following procedure.
An aqueous solution of the fire extinguisher diluted with fresh water to a concentration of 3% was foamed by the method herein above described. Immediately then, 5 cc of the foams were collected and placed gently on 100 cc of a polar sovent. The time which elapsed from the placing until the foams completely disappeared was measured.

What is claimed is:

1. An aqueous foam fire extinguisher comprising (A) a fluorine-containing aminosulfonate-type surface-active agent of formula (A-2)

$$Rf—Z—Q_1—N(R)—Q_2SO_3M$$

wherein Rf represents a fluorinated aliphatic group having 3 to 20 carbon atoms, Z is a divalent linking group selected from the group consisting of $—SO_2N(R_1)—$, $—CON(R_1)—$, $—(CH_2CH_2)_i—SO_2N(R_1)—$,

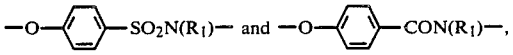

in which $R_1$ represents a hydrogen atom or an alkyl group having 1 to 12 carbon atoms, and i represents an integer of 1 to 10, $Q_1$ represents $(—CH_2)j$, in which j is an integer of 1 to 6 or $$—CH_2\underset{\underset{OR_2}{|}}{C}HCH_2—,$$

in which j is an integer of 1 to 6 or $$—CH_2\underset{\underset{OR_2}{|}}{C}HCH_2—,$$

in which $R_2$ represents an hydrogen atom or an alkyl group having 1 to 3 carbon atoms, R represents a hydrogen atom, an alkyl or hydroxyalkyl group having 1 to 3 carbon atoms, $—Q_2SO_3M$ or $—(CH_2)_kCOOM$, in which k represents an integer of 1 to 4, $Q_2$ represents $(—CH_2)_l—$ in which l represents an integer of 1 to 4, $$—CH_2\underset{\underset{OR_3}{|}}{C}HCH_2—,$$

in which $R_3$ represents a hydrogen atom or an alkyl group having 1 to 3 carbon atoms, or

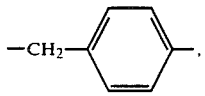

M represents a cationic atom or atomic grouping selected from the group consisting of a hydrogen atom, an alkaline earth metal and $—N(H)_m(R_4)_n$, in which $R_4$ represents an alkyl or hydroxyalkyl group having 1 to 3 carbon atoms, and m and n are integers of 0 to 4 provided that $m+n=4$, and (B) a cationic water-soluble polymeric substance which is a polyamine-type polymeric substance having a primary amino group, a secondary amino group, a tertiary amino group, an ammonium group, a pyridinium group or a quaternary ammonium group in the main chain or side chain, the weight ratio of the component (B) to the component (A), B/A, being from 0.05 to 50.

2. An aqueous foam fire extinguisher comprising (A) a fluorine-containing aminosulfonate-type surface-active agent of formula (A-2)

$$Rf—Z—Q_1—N(R)—Q_2—SO_3M$$

wherein Rf represents a fluorinated aliphatic group having 3 to 20 carbon atoms, Z is a divalent linking group selected from the group consisting of $—SO_2N(R_1)—$, $—CON(R_1)—$, $—(CH_2CH_2)_iSO_2N(R_1)—$,

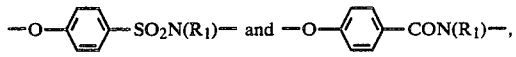

in which $R_1$ represents a hydrogen atom or an alkyl group having 1 to 12 carbon atoms, and i represents an integer of 1 to 10, $Q_1$ represents $(—CH_2)_j$, in which j is an integer of 1 to 6 or $$—CH_2\underset{\underset{OR_2}{|}}{C}HCH_2—,$$

in which $R_2$ represents a hydrogen atom or an alkyl group having 1 to 3 carbon atoms, R represents a hydrogen atom, an alkyl or hydroxyalkyl group having 1 to 3 carbon atoms, $—Q_2SO_3M$ or $—(CH_2)_kCOOM$, in which k represents an integer of 1 to 4, $Q_2$ represents $(—CH_2)_l—$ in which l represents an integer of 1 to 4, $$—CH_2\underset{\underset{OR_3}{|}}{C}HCH_2—,$$

in which $R_3$ represents a hydrogen atom or an alkyl group having 1 to 3 carbon atoms, or

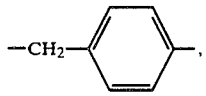

M represents a cationic atom or atomic grouping selected from the group consisting of a hydrogen atom, an alkaline earth metal and $—N(H)_m(R_4)_n$, in which $R_4$ represents an alkyl or hydroxyalkyl group having 1 to 3 carbon atoms, and m and n are integers of 0 to 4 provided that $m+n=4$, (B) a cationic water-soluble polymeric substance which is a polyamine-type polymeric substance having a primary amino group, a secondary amino group, a tertiary amino group, an ammonium group, a pyridinium group or a quaternary ammonium group in the main chain or side chain, and (C) a polybasic acid compound which is an aromatic, aliphatic, alicyclic or heterocyclic dibasic, tribasic, tetrabasic, pentabasic or hexabasic acid having carboxylic, sulfonic or phosphoric acid groups, the weight ratio of the component (B) to the component (A), B/A, being from 0.05 to 50, the weight ratio of the component (A) to the component (B) plus the component (C), A/B+C being from 0.01 to 10, and the weight ratio of the component (B) to the component (C), B/C being from 5 to one-third.

3. An aqueous foam fire extinguisher comprising (A) a fluorine-containing aminocarboxylate-type surface-active agent of formula (A-3)

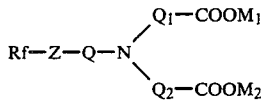

wherein Rf represents a polyfluoralkyl group having 3 to 20 carbon atoms which may contain an oxygen atom, a polyfluoroalkenyl group, a polyfluorocyclohexyl group, a polyfluorocyclohexylalkyl group or a polyfluorocyclohexyl-alkenyl group, Z represents a divalent linking group selected from the group consisting of

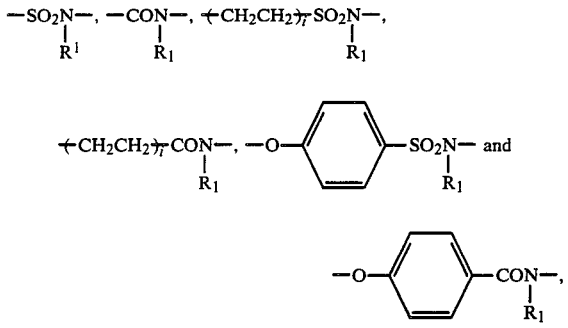

in which $R_1$ represents an alkyl group having 1 to 12 carbon atoms, an alkenyl group, a monovalent group containing an aromatic ring, or $-(CH_2CH_2)_jR_2$, in which $R_2$ represents a hydrogen atom or an alkyl group having 1 to 6 carbon atoms, and j represents an integer of 1 to 6, and i represents an integer of 1 to 3, Q represents $-(CH_2)-_l$,

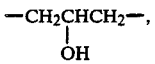

$-(CH_2)-_mO-(CH_2)-_m$ or $-(CH_2)-_pO-(CH_2)-_2O-(CH_2)-_q$, in which l is an integer of 1 to 6, m and n are integers of 2 to 6, and p and q are 2 or 3, and each of $Q_1$ and $Q_2$ represents a divalent linking group $-(CH_2)-_r$ or $-(CH_2)-_s$ in which r and s are integers of 1 to 3 and each of $M_1$ and $M_2$ represents a hydrogen atom or an inorganic or organic cation, and (B) a cationic water-soluble polymeric substance which is a polyamine-type polymeric substance having a primary amino group, a secondary amino group, a tertiary amino group, an ammonium group, a pyridinium group or a quaternary ammonium group in the main chain or side chain, the weight ratio of the component (B) to the component (A), B/A being from 0.05 to 50.

4. An aqueous foam fire-extinguisher comprising (A) a fluorine-containing aminocarboxylate-type surface-active agent of formula (A-2)

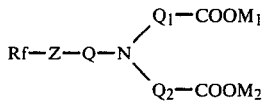

wherein Rf represents a polyfluoroalkyl group having 3 to 20 carbon atoms which may contain an oxygen atom, a polyfluoroalkenyl group, a polyfluorocyclohexyl group, a polyfluorocyclohexylalkyl group or a polyfluorocyclohexylalkenyl group, Z represents a divalent linking group selected from the group consisting of

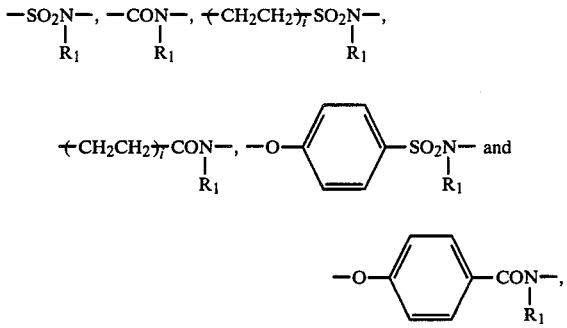

in which $R_1$ represents an alkyl group having 1 to 12 carbon atoms, an alkenyl group, a monovalent group containing an aromatic ring, or $-(CH_2CH_2)_jR_2$, in which $R_2$ represents a hydrogen atom or an alkyl group having 1 to 6 carbon atoms, and j represents an integer of 1 to 6, and i represents an integer of 1 to 3, Q represents $-(CH_2)-_l$,

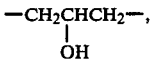

$-(CH_2)-_mO-(CH_2)-_m$ or $-(CH_2)-_pO-(CH_2)-_2O-(CH_2)-_q$, in which l is a integer of 1 to 6, m and n are integers of 2 to 6, and p and q are 2 or 3, and each of $M_1$ and $M_2$ represents a hydrogen atom or an inorganic or organic cation, (B) a cationic water-soluble polymeric substance which is a polyamine-type polymeric substance having a primary amino group, a secondary amino group, a tertiary amino group, an ammonium group, a pyridinium group or a quaternary ammonium group in the main chain or side chain, and (C) a polybasic acid compound which is an aromatic aliphatic, alicyclic or heterocyclic dibasic, tribasic, tetrabasic, pentabasic or hexabasic acid having carboxylic, sulfonic or phosphoric acid groups, the weight ratio of the component (B) to the component (A), B/A being from 0.05 to 50, the weight ratio of the component (A) to the component (B) plus the component (C), A/B+C being from 0.01 to 10, and the weight ratio of the component (B) to the component (C), B/C being from 5 to one-third.

5. An aqueous foam fire-extinguisher comprising (A) a fluorine-containing surface-active agent selected from the group consisting of

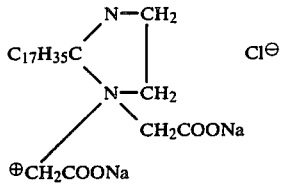

$C_{11}H_{23}CONHCH_2CH_2N(CH_2COONa)_2$,
$C_{17}H_{35}CONH(CH_2)_3N^{\oplus}[(CH_2)_3SO_3Na]_3Cl^{\beta}$

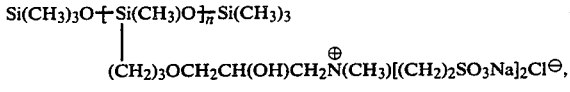

$C_8F_{17}SO_2N(C_3H_7)CH_2COOK$,
$C_8F_{17}SO_2N(C_3H_7)CH_2CH_2OSO_3Na$ and
$C_7F_{15}CON(C_3H_7)(CH_2)_3SO_3Na$, and (B) a cationic water-soluble polymeric substance which is a polyamine-type polymeric substance having a primary amino group, a secondary amino group, a tertiary amino group, an ammonium group, a pyridinium group or a quaternary ammonium group in the main chain or side chain, the weight ratio of the component (B) to the component (A), B/A being from 0.05 to 50.

6. An aqueous foam fire-extinguisher comprising (A) a fluorine-containing surface-active agent (A) is a compound selected from the group consisting of

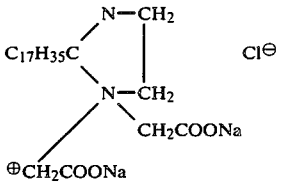

$C_{11}H_{23}CONHCH_2CH_2N(CH_2COONa)_2$,
$C_{17}H_{35}CONH(CH_2)_3N^{\oplus}[(CH_2)_3SO_3Na]_3Cl^{\ominus}$

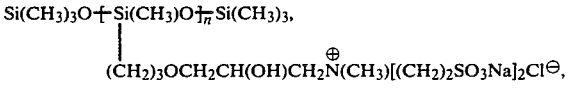

$C_8F_{17}SO_2N(C_3H_7)CH_2COOK$,
$C_8F_{17}SO_2N(C_3H_7)CH_2CH_2OSO_3Na$ and
$C_7F_{15}CON(C_3H_7)(CH_2)_3SO_3Na$, (B) a cationic water-soluble polymeric substance which is a polyamine-type polymeric substance having a primary amino group, a secondary amino group, a tertiary amino group, an ammonium group, a pyridinium group or a quaternary ammonium group in the main chain or side chain, and (C) a polybasic acid compound which is an aromatic, aliphatic, alicyclic or heterocyclic dibasic, tribasic, tetrabasic, pentabasic or hexabasic acid having carboxylic, sulfonic or phosphoric acid groups, the weight ratio of the component (B) to the component (A), B/A being from 0.05 to 50, the weight ratio of the component (A) to the component (B) plus the component (C), A/B+C being from 0.01 to 10, and the weight ratio of the component (B) to the component (C), B/C being from 5 to one-third.

7. An aqueous foam fire extinguisher comprising (A) a surface-active agent containing an anionic hydrophilic group selected from the group consisting of —COO—, —$SO_3$—, —$OSO_3$— and —OPO(OH)O—, or containing a combination of the anionic hydrophilic group and a cationic hydrophilic group, and (B) a cationic water-soluble polymeric substance selected from the group consisting of polyethyleneimine, polymer of

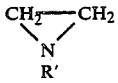

wherein R' is —$C_nH_{2n+1}$, —$COC_nH_{2n+1}$, or $-(CH_2CH_2O)_nH$ in which n is an integer of 1 to 6, Polymer of $CH_2{=}CH$

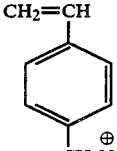

$CH_2N^{\oplus}(CH_3)_3Cl^{\ominus}$,

Polymer of $CH_2{=}CH$

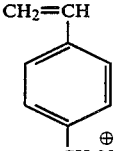

$CH_2N^{\oplus}(CH_3)_2CH_2CH_2OHCl^{\ominus}$,

Polymer of $CH_2{=}CH$

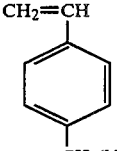

$CH_2(NHCH_2CH_2)_mNH_2$,

Polymer of $CH_2{=}CH$

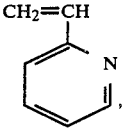

Polymer of $CH_2{=}CH$
$N(CH_3)_2$,

Polymer of $CH_2{=}CH$
$N(C_2H_5)_2$, polyamide polyamine epichlorohydrin, and guanidineformaldehyde polycondensate.

the weight ratio of the component (B) to the component (A), B/A being from 0.05 to 50.

8. An aqueous foam fire extinguisher comprising (A) hydrophilic group selected from the group consisting of —COO—, —$SO_3$—, —$OSO_3$— and —OPO(OH)O—, or containing a combination of the anionic hydrophilic group and a cationic hydrophilic group, (B) a cationic water-soluble polymeric substance selected from the group consisting of polyethylenimine, polymer of

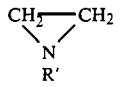

wherein R′ is $—C_nH_{2n+1}$, $—COC_nH_{2n+1}$, or $-(CH_2CH_2O)_nH$ in which n is a integer of 1 to 6, Polymer of $CH_2=CH$

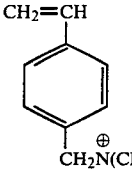

$CH_2\overset{\oplus}{N}(CH_3)_3Cl^{\ominus}$,

Polymer of $CH_2=CH$

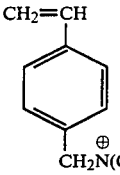

$CH_2\overset{\oplus}{N}(CH_3)_2CH_2CH_2OHCl^{\ominus}$,

Polymer of $CH_2=CH$

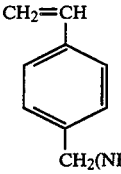

$CH_2(NHCH_2CH_2)_mNH_2$,

Polymer of $CH_2=CH$

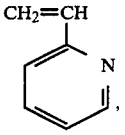

Polymer of $CH_2=CH$
|
$N(CH_3)_2$,

Polymer of $CH_2=CH$
|
$N(C_2H_5)_2$, polyamide polyamine epichlorohydrin, and guanidineformaldehyde polycondensate, and (C) a polybasic acid compound which is an aromatic, aliphatic, alicyclic or heterocyclic dibasic, tribasic, tetrabasic, pentabasic or hexabasic acid having carboxylic, sulfonic or phosphoric acid groups, the weight ratio of the component (B) to the component (A), B/A being from 0.05 to 50, the weight ratio of the component (A) to the component (B) plus the component (C), A/B+C being from 0.01 to 10, and the weight ratio of the component (B) to the component (C), B/C being from 5 to one-third.

9. The fire extinguisher of any one of claims 2, 4, 6 or 8 wherein the polybasic acid compound (C) is a dibasic acid compound having 3 to 24 carbon atoms and having carboxylic acid groups.

10. The fire extinguisher of claim 7 or 8 wherein the surface-active agent is an amphoteric surface-active agent of the following formula (A-1)

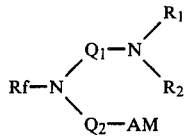

wherein Rf represents a fluorinated aliphatic group having 3 to 20 carbon atoms, Y represents $—SO_2—$ or —CO—, $Q_1$ and $Q_2$ each represent an organic divalent linking group selected from the group consisting of aliphatic hydrocarbon groups, hydroxyl-substituted aliphatic hydrocarbon groups, aromatic hydrocarbon groups and substituted aromatic hydrocarbon groups, $R_1$ and $R_2$ represent a hydrogen atom, an aliphatic hydrocarbon group having 1 to 12 carbon atoms, or an aliphatic hydrocarbon group substituted by a hydrophilic group, or $R_1$ and $R_2$ are linked to each other to form a ring together with the adjacent nitrogen atom, A represents said anionic hydrophilic group and M represents a hydrogen atom, an alkali metal, an alkaline earth metal, or ammonium group or an organic cationic group.

11. The fire extinguisher of claim 10 wherein in the formula (A-1), $Q_1$ and $Q_2$ represent $—CH_2—_j$ in which j is an integer of 1 to 6, or $$—CH_2\underset{\underset{OR_3}{|}}{C}HCH_2—,$$

in which $R_3$ is a hydrogen atom or an alkyl group having 1 to 3 carbon atoms.

12. A method for extinguishing fires of water-soluble solvents which comprises applying to the site of the fire a foam of the aqueous foam fire extinguisher of any one of claims 1, 2, 3, 4, 5, 6, 7, and 8.

* * * * *

UNITED STATES PATENT AND TRADEMARK OFFICE

CERTIFICATE OF CORRECTION

PATENT NO. : 4,536,298

DATED : August 20, 1985

INVENTOR(S) : MASAYUKI KAMEI, ET AL.

It is certified that error appears in the above-identified patent and that said Letters Patent is hereby corrected as shown below:

--Claim 5, line 15, delete "$Cl^{\beta}$", insert --$Cl^{\theta}$--.

Signed and Sealed this

*Fifteenth* Day of *October 1985*

[SEAL]

*Attest:*

DONALD J. QUIGG

*Attesting Officer*

*Commissioner of Patents and Trademarks—Designate*